US010290983B2

(12) United States Patent
Harashima et al.

(10) Patent No.: US 10,290,983 B2
(45) **Date of Patent: *May 14, 2019**

(54) ELECTRONIC DEVICE

(71) Applicant: Toshiba Memory Corporation, Minato-ku (JP)

(72) Inventors: Shiro Harashima, Sagamihara (JP); Masayuki Dohi, Yokohama (JP)

(73) Assignee: TOSHIBA MEMORY CORPORATION, Minato-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/021,127

(22) Filed: Jun. 28, 2018

(65) Prior Publication Data

US 2018/0309249 A1 Oct. 25, 2018

Related U.S. Application Data

(63) Continuation of application No. 15/259,209, filed on Sep. 8, 2016, now Pat. No. 10,038,285.

(60) Provisional application No. 62/301,133, filed on Feb. 29, 2016.

(51) Int. Cl.

| | |
|---|---|
| ***H01R 12/57*** | (2011.01) |
| ***H01R 24/60*** | (2011.01) |
| *H01R 107/00* | (2006.01) |
| *H01R 12/72* | (2011.01) |

(52) U.S. Cl.

CPC ..... *H01R 24/60* (2013.01); *H01R 12/57* (2013.01); *H01R 12/724* (2013.01); *H01R 2107/00* (2013.01)

(58) Field of Classification Search

CPC ..... H01R 24/60; H01R 13/6585
USPC ..... 439/218, 660, 78
See application file for complete search history.

(56) References Cited

U.S. PATENT DOCUMENTS

| | | | | |
|---|---|---|---|---|
| 8,079,854 | B2 | 12/2011 | He et al. | |
| 8,777,672 | B2 | 7/2014 | Chung et al. | |
| 9,325,128 | B2 | 4/2016 | Chen et al. | |
| 9,478,923 | B2 * | 10/2016 | Kao | H01R 24/60 |
| 9,515,436 | B2 * | 12/2016 | Kao | H01R 24/60 |
| 9,685,739 | B2 * | 6/2017 | Chen | H01R 13/6585 |

(Continued)

FOREIGN PATENT DOCUMENTS

| | | |
|---|---|---|
| CN | 204834939 U | 12/2015 |
| JP | 2008-277253 | 11/2008 |
| JP | 2011-29174 A | 2/2011 |

(Continued)

*Primary Examiner* — Abdullah A Riyami
*Assistant Examiner* — Nader J Alhawamdeh
(74) *Attorney, Agent, or Firm* — Oblon, McClelland, Maier & Neustadt, L.L.P.

(57) ABSTRACT

According to one embodiment, an electronic device includes a substrate, a male connector, and conductive members. The substrate includes conductors on a surface of the substrate. The male connector is mounted on the substrate and insertable into a female connector complying with a USB Type-C standard. The conductive members are mounted in the male connector, each of the conductive members electrically connecting one of twenty-four terminals complying with the USB Type-C standard mounted in the female connector with one of the conductors when the male connector is inserted into the female connector, and a number of the conductive members being less than twenty-four.

20 Claims, 12 Drawing Sheets

(56) References Cited

U.S. PATENT DOCUMENTS

2015/0318646 A1* 11/2015 Little ..... H01R 4/023
439/78

FOREIGN PATENT DOCUMENTS

| | | | |
|---|---|---|---|
| JP | 2011-34960 | A | 2/2011 |
| JP | 2013-118165 | A | 6/2013 |
| JP | 2014-60043 | A | 4/2014 |
| JP | 3195845 | U | 2/2015 |
| JP | 3197730 | U | 6/2015 |
| TW | M475071 | U | 3/2014 |

* cited by examiner

ELECTRONIC DEVICE

CROSS-REFERENCE TO RELATED APPLICATIONS

This application is a continuation of and claims the benefit of priority under 35 U.S.C. § 120 from U.S. application Ser. No. 15/259,209 filed Sep. 8, 2016, and claims the benefit of priority from U.S. Provisional Application No. 62/301,133 filed Feb. 29, 2016; the entire contents of each of which are incorporated herein by reference.

FIELD

Embodiments described herein relate generally to an electronic device.

BACKGROUND

There are cases in which an electronic device is equipped with a connector.

DETAILED DESCRIPTION

In general, according to one embodiment, an electronic device includes: a substrate including a plurality of conductors on a surface of the substrate; a male connector that is mounted on the substrate and insertable into a female connector complying with a USB Type-C standard; and a plurality of conductive members that are mounted in the male connector, each of the conductive members configured to electrically connect one of twenty-four terminals complying with the USB Type-C standard mounted in the female connector with one of the plurality of conductors when the male connector is inserted into the female connector, a number of the conductive members being less than twenty-four.

Exemplary embodiments of an electronic device will be described below in detail with reference to the accompanying drawings. The present invention is not limited to the following embodiments.

First Embodiment

A first embodiment will be described with reference to FIGS. 1 to 8. A plurality of expressions may be used for an element according to an embodiment or a description of the element. Another expression that is not described herein may be used for the element and a description thereof. Another expression may be used for the elements and a description thereof in which a plurality of expressions are not described.

Figure 1:
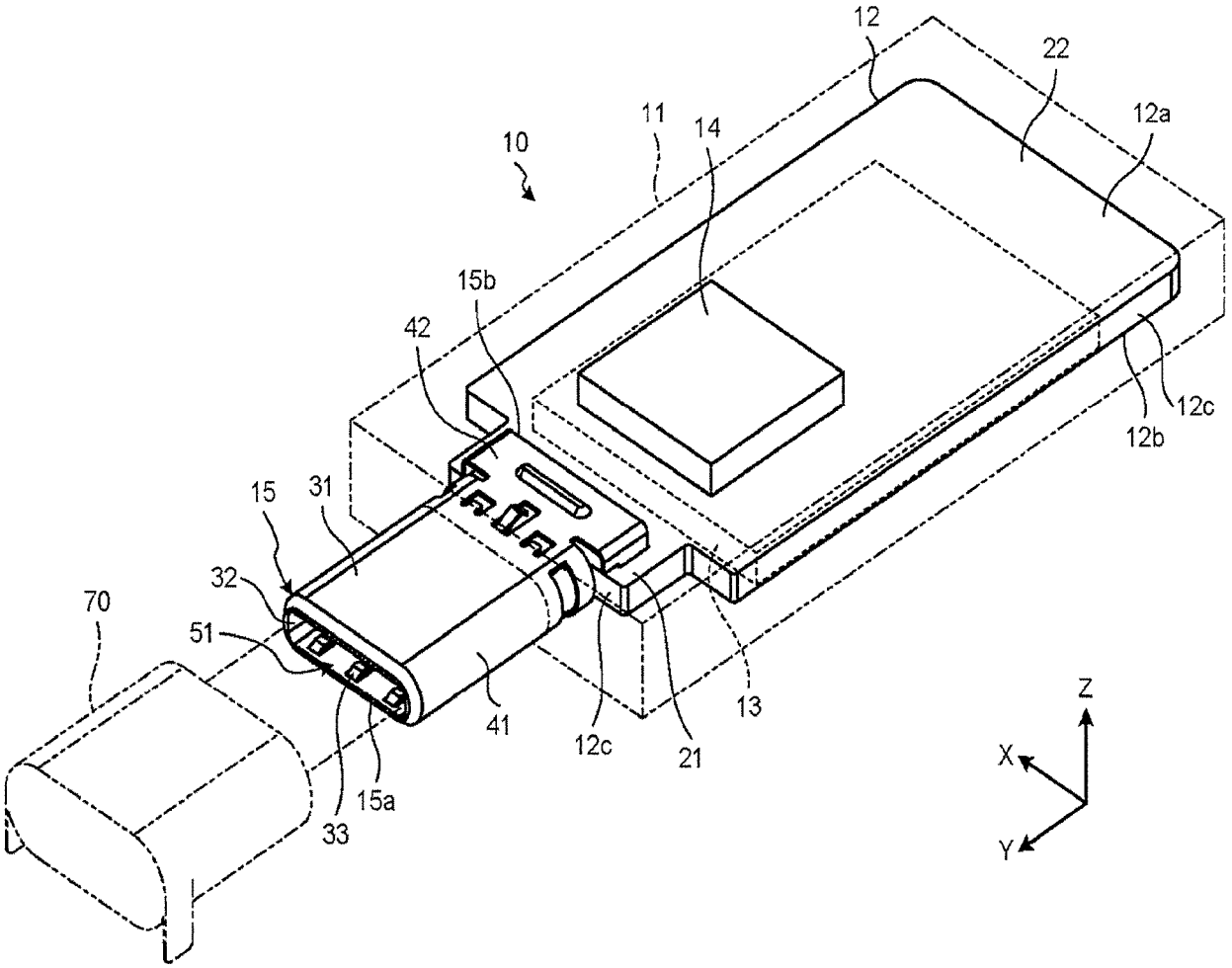
FIG. 1 is a perspective view illustrating a USB drive according to a first embodiment.

FIG. 1 is a perspective view illustrating a USB flash drive (hereinafter, referred to as a "USB drive") 10 according to the first embodiment. The USB drive 10 is an example of an electronic device and may be referred to as, for example, a semiconductor memory device, a semiconductor device, a storage device, an auxiliary storage device, a removable medium, or a device. The electronic device may be, for example, a portable computer, a tablet, a television receiver, a display, a smart phone, a mobile phone, an IC recorder, consumer electronics, an auxiliary storage device such as a hard disk drive (HDD) or a solid state drive (SSD), a cable or an adapter for connecting a device with another device, or any other electronic device.

The USB drive 10 according to the present embodiment is formed in, for example, a rectangular parallelepiped shape as illustrated in FIG. 1. The USB drive 10 may be formed in any other shape. As illustrated in the drawings, in this specification, an X axis, a Y axis, and a Z axis are defined. The X axis, the Y axis, and the Z axis are orthogonal to one another. The X axis runs along the width of the USB drive 10. The Y axis runs along the length of the USB drive 10. The Z axis runs along the thickness of the USB drive 10.

The USB drive 10 includes a casing 11, a substrate 12, a flash memory 13, a controller 14, and a plug 15. The flash memory 13 may be also referred to as, for example, a non-volatile memory, a memory, a storage unit, or an electronic component. The controller 14 may be also referred to as, for example, a control unit or an electronic component. The plug 15 is an example of a male connector and may be referred to as, for example, a connector, an inserting unit, or a connecting unit.

In FIG. 1, the casing 11 is indicated by an alternate long and two short dashes line. The casing 11 accommodates the substrate 12, the flash memory 13, the controller 14, and a part of the plug 15. The casing 11 may include, for example, a cap for accommodating the plug 15. The casing 11 is, for example, made of synthetic resin or metal.

The substrate 12 is, for example, a printed circuit board (PCB). The substrate 12 may be any other substrate such as a flexible printed circuit board (FPC). The substrate 12 is formed in a substantially quadrilateral (rectangular) shape. The substrate 12 may be formed in any other shape.

Figure 2:
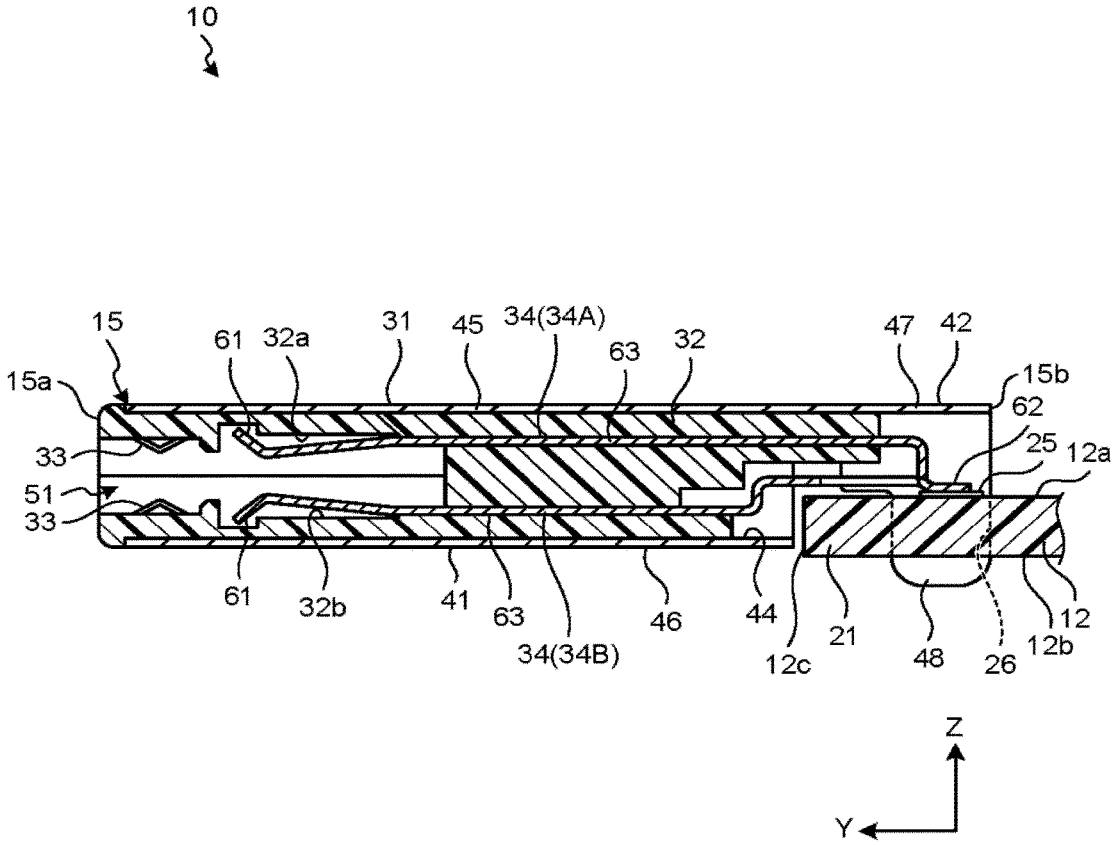
FIG. 2 is a cross-sectional view schematically illustrating a part of the USB drive of the first embodiment.

FIG. 2 is a cross-sectional view schematically illustrating a part of the USB drive 10 of the first embodiment. The substrate 12 includes a first face 12*a*, a second face 12*b*, and a plurality of end faces 12*c* as illustrated in FIG. 2. Each of the first face 12*a*, the second face 12*b* and the end faces 12*c* is an example of a surface.

The first face 12*a* is a substantially flat face that faces in a positive direction along the Z axis (a direction in which an arrow of the Z axis faces, that is, an upward direction in FIG. 2). The second face 12*b* is positioned at the opposite side to the first face 12*a*. The second face 12*b* is a substantially flat face that faces in a negative direction along the Z axis (an opposite direction to a direction in which an arrow of the Z axis faces, that is, a downward direction in FIG. 2). Each of the plurality of end faces 12*c* connects the end of the first face 12*a* with the end of the second face 12*b*.

The substrate 12 includes a front end portion 21, a rear end portion 22, a first side end portion 23, and a second side end portion 24 as illustrated in FIG. 1. The names of the front end portion 21, the rear end portion 22, the first side end portion 23, and the second side end portion 24 are given for the sake of description and not intended to limit the positions and the directions of the front end portion 21 and the rear end portion 22.

The front end portion 21 is a part of the substrate 12 that includes the end face 12*c* of the substrate 12 which faces in a positive direction along the Y axis (a direction in which an arrow of the Y axis faces) and parts of the first face 12*a* and the second face 12*b* adjacent to the end face 12*c*. The front end portion 21 extends in a direction along the X axis.

The rear end portion 22 is a part of the substrate 12 that includes the end face 12*c* of the substrate 12 which faces in a negative direction along the Y axis (an opposite direction to a direction in which an arrow of the Y axis faces) and parts of the first face 12*a* and the second face 12*b* adjacent to the end face 12*c*. The rear end portion 22 is separated from the front end portion 21 in the direction along the Y axis and extends in the direction along the X axis.

The first side end portion 23 is a part of the substrate 12 that includes the end face 12*c* of the substrate 12 which faces in a positive direction along the X axis (a direction in which an arrow of the X axis faces) and parts of the first face 12*a* and the second face 12*b* adjacent to the end face 12*c*. The first side end portion 23 extends in the direction along the Y axis.

The second side end portion 24 is a part of the substrate 12 that includes the end face 12*c* of the substrate 12 which faces in a negative direction along the X axis (an opposite direction to a direction in which an arrow of the X axis faces) and parts of the first face 12*a* and the second face 12*b* adjacent to the end face 12*c*. The second side end portion 24 is separated from the first side end portion 23 in the direction along the X axis and extends in the direction along the Y axis.

The substrate 12 has a substantially rectangular shape in a planar view of the first face 12*a*. The substrate 12 extends in the direction along the Y axis. A distance between the front end portion 21 and the rear end portion 22 in the direction along the Y axis is larger than a distance between the first side end portion 23 and the second side end portion 24 in the direction along the X axis. The direction along the Y axis may be referred to as a long-side direction. The direction along the X axis may be referred to as a short-side direction.

Figure 3:
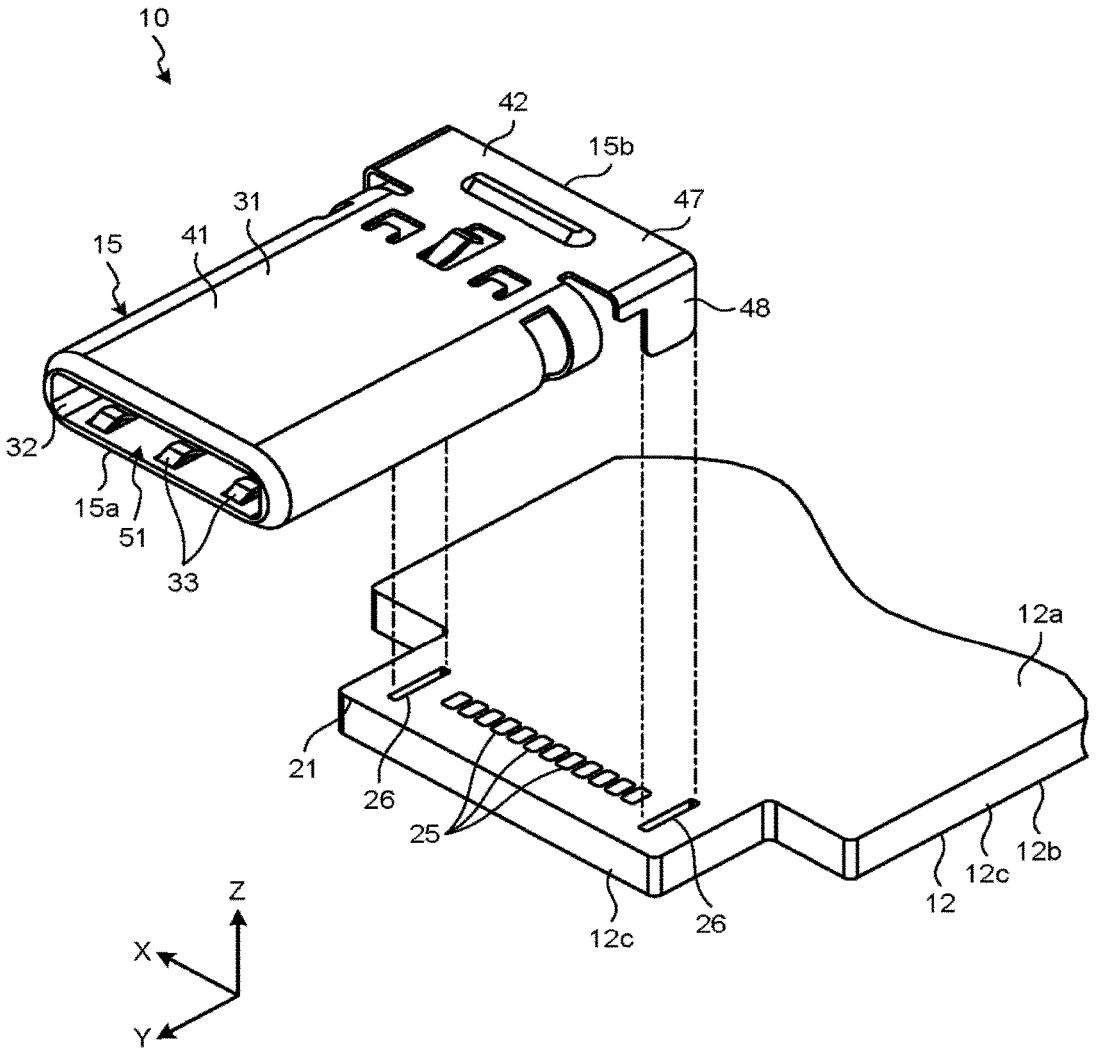
FIG. 3 is a perspective view illustrating a part of a substrate and a plug of the first embodiment.

FIG. 3 is a perspective view illustrating a part of the substrate 12 and the plug 15 of the first embodiment. A plurality of pads 25 and two holes 26 are provided in the front end portion 21 of the substrate 12 as illustrated in FIG. 3. The pad 25 is an example of a conductor, and may be also referred to as, for example, a land, a conductor, an electrode, or a metallic portion.

In the first embodiment, the plurality of pads 25 are mounted on the first face 12*a* of the substrate 12. In the first embodiment, the plurality of pads 25 are arranged in the direction along the X axis. The direction along the X axis is an example of one direction. The plurality of pads 25 may be arranged in the other direction.

The two holes 26 penetrate the substrate 12 in the direction along the Z axis. In other words, the hole 26 opens in the first face 12*a* and the second face 12*b*. The two holes 26 are arranged in the direction along the X axis. The plurality of pads 25 are arranged between the two holes 26 in the direction along the X axis. The plurality of pads 25 may be arranged at any other position.

The flash memory 13 indicated by a broken line in FIG. 1 is mounted on the second face 12*b* of the substrate 12. For example, a plurality of terminals provided in the flash memory 13 are electrically connected to a plurality of electrodes provided on the second face 12*b* by soldering. The flash memory 13 may be mounted on the first face 12*a*. A plurality of flash memories 13 may be mounted on both the first face 12*a* and the second face 12*b*.

The flash memory 13 is, for example, a NAND flash memory. The USB drive 10 is not limited to the NAND flash memory 13 but may include any other non-volatile memory such as a NOR flash memory, a magnetoresistive random access memory (MRAM), a phase change random access memory (PRAM), a resistive random access memory (ReRAM), or a ferroelectric random access memory (FeRAM).

The controller 14 is mounted on the first face 12*a* of the substrate 12. For example, a plurality of terminals provided in the controller 14 are electrically connected to a plurality of electrodes provided on the first face 12*a* by soldering. The controller 14 may be mounted on the second face 12*b*. The controller 14 is electrically connected to the plurality of pads 25 and the flash memory 13, for example, through a plurality of electrodes and wirings of the substrate 12.

The plug 15 is attached to the front end portion 21 of the substrate 12. The plug 15 is mounted on the first face 12*a* of the substrate 12. For example, the plug 15 may be mounted on the second face 12*b* of the substrate 12 or may be accommodated in a cut-out formed in the substrate 12 and mounted on the substrate 12.

The plug 15 extends in the direction along the Y axis. The plug 15 includes a distal end portion 15*a* and a proximal end portion 15*b*. The distal end portion 15*a* is an end portion of the plug 15 in the positive direction along the Y axis. The proximal end portion 15*b* is an end portion of the plug 15 in the negative direction along the Y axis.

As illustrated in FIG. 2, the plug 15 includes a housing 31, an insulating part 32, a plurality of springs 33, and a plurality of pins 34. The insulating part 32 may be also referred to as, for example, a separating portion, an intervening portion, an insulating portion, a part, or a member. The plurality of pins 34 are an example of a plurality of conductive members and may be referred to as, for example, a signal terminal, a terminal, a connecting portion, a conductive portion, or a member.

The housing 31 is made of metal. The housing 31 may be made of other materials. The housing 31 accommodates at least a part of the insulating part 32, the plurality of springs 33, and at least a part of the plurality of pins 34. The housing 31 includes a tubular portion 41 and an attaching portion 42.

The tubular portion 41 is formed in a tubular shape extending in the direction along the Y axis. An accommodation room 44 is formed in the tubular portion 41. The accommodation room 44 is a hole that is formed in the tubular portion 41 and extends in the direction along the Y axis. A cross section of the accommodation room 44 is formed in a substantially oval shape extending in the direction along the X axis. The accommodation room 44 may be formed in any other shape.

The tubular portion 41 includes an upper wall 45 and a lower wall 46. Each of the upper wall 45 and the lower wall 46 is a portion having a substantially flat board shape which lies in an X-Y plane. The lower wall 46 is positioned in the negative direction along the Z axis further than the upper wall 45. The upper wall 45 and the lower wall 46 face each other.

Both end portions of the upper wall 45 in the direction along the X axis and both end portions of the lower wall 46 in the direction along the X axis are connected by arc-like walls. Thus, the tubular portion 41 is formed in a substantially oval tubular shape.

The attaching portion 42 includes an extension wall 47 and two protrusion walls 48. The extension wall 47 extends in the negative direction along the Y axis from an end portion of the upper wall 45 in the negative direction along the Y axis. In other words, the extension wall 47 continues from the upper wall 45. The two protrusion walls 48 protrude from both end portions of the extension wall 47 in the direction along the X axis in the negative direction along the Z axis. The attaching portion 42 may have a different shape from the shape according to the present embodiment.

At least a part of the insulating part 32 is accommodated in the accommodation room 44 of the tubular portion 41. The insulating part 32 is made, for example, of synthetic resin. The insulating part 32 may be made of any other material having an insulation property. In FIG. 2, the insulating part 32 is illustrated as one member, but, for example, the insulating part 32 may be formed of a plurality of members.

An insertion opening 51 is formed in the plug 15. The insertion opening 51 is, for example, an opening formed by the insulating part 32 accommodated in the housing 31. The insertion opening 51 opens in the distal end portion 15*a* of the plug 15.

The insulating part 32 includes a first inner face 32*a* and a second inner face 32*b*. Each of the first inner face 32*a* and the second inner face 32*b* forms a part of the insertion opening 51. The first inner face 32*a* faces in the negative direction along the Z axis. The second inner face 32*b* faces in the positive direction along the Z axis. The first inner face 32*a* and the second inner face 32*b* face each other. The first inner face 32*a* and the second inner face 32*b* are formed to be substantially flat. A protrusion, a concavity, or a hole may be provided on the first inner face 32*a* and the second inner face 32*b*.

The plurality of springs 33 are, for example, leaf springs. The plurality of springs 33 are attached to the insulating part 32. Some of the plurality of springs 33 protrude from the first inner face 32*a* toward the second inner face 32*b* and can be elastically bent toward the first inner face 32*a*. The remaining springs among the plurality of springs 33 protrude from the second inner face 32*b* toward the first inner face 32*a* and can be elastically bent toward the second inner face 32*b*. The plurality of springs 33 are arranged in the direction along the X axis.

Each of the plurality of pins 34 is made of a conductor such as metal. The plurality of pins 34 include a plurality of upper pins 34A and a plurality of lower pins 34B. The names of the upper pin 34A and the lower pin 34B are given based on the positions of the upper pin 34A and the lower pin 34B in FIG. 2 for the sake of description and not intended to limit the positions of the upper pin 34A and the lower pin 34B. In the following description, a description for a pin 34 is used for a description common to the upper pin 34A and the lower pin 34B.

Each of the plurality of pins 34 extends in substantially the direction along the Y axis in general. Each of the plurality of pins 34 has a bent portion. In other words, each of the plurality of pins 34 has a portion extending in a different direction from the Y axis. Each of the plurality of pins 34 includes a terminal portion 61, a connecting portion 62, and an extending portion 63. Each of the terminal portion 61 and the connecting portion 62 may be also referred to as an end portion.

The terminal portion 61 is provided on one end portion of the pin 34. The terminal portion 61 not only includes one end of the pin 34, but includes a portion which is adjacent to the one end. The terminal portion 61 is a portion of the pin 34, and is not limited to the end of the pin 34. The terminal portion 61 is a part of the pin 34 that is bent convexly toward the inside of the insertion opening 51. The connecting portion 62 is provided on the other end portion of the pin 34. The connecting portion 62 not only includes the other end of the pin 34, but includes a portion which is adjacent to the other end. The connecting portion 62 is a portion of the pin 34, and is not limited to the end of the pin 34. The terminal portion 61 is closer to the distal end portion 15*a* of the plug 15 than the connecting portion 62. The connecting portion 62 is closer to the proximal end portion 15*b* of the plug 15 than the terminal portion 61.

The extending portion 63 is positioned between the terminal portion 61 and the connecting portion 62. The extending portion 63 passes through, for example, a hole, a groove, or a slit formed in the insulating part 32 and extends in substantially the direction along the Y axis in general. The extending portion 63 may include a bent portion extending in a different direction from the direction along the Y axis. The extending portion 63 is held by the insulating part 32.

The terminal portion 61 extends from one end portion of the extending portion 63. The terminal portion 61 is positioned in the accommodation room 44. The terminal portion 61 is closer to the proximal end portion 15*b* of the plug 15 than the spring 33. The terminal portion 61 can be elastically deformed to move in the accommodation room 44.

Each of the terminal portions 61 of the plurality of upper pins 34A is arranged around the first inner face 32*a* of the insulating part 32. The terminal portion 61 of the upper pin 34A is usually separated from the first inner face 32*a*. Thus, the terminal portion 61 of the upper pin 34A can elastically move toward the first inner face 32*a*. The terminal portions 61 of the plurality of upper pins 34A are arranged in the direction along the X axis.

Each of the terminal portions 61 of the plurality of lower pins 34B is arranged around the second inner face 32*b* of the insulating part 32. The terminal portion 61 of the lower pin 34B is usually separated from the second inner face 32*b*. Thus, the terminal portion 61 of the lower pin 34B can elastically move toward the second inner face 32*b*. The terminal portions 61 of the plurality of lower pins 34B are arranged in the direction along the X axis.

The terminal portions 61 of the plurality of lower pins 34B are arranged at substantially the same positions as the terminal portions 61 of the plurality of upper pins 34A in the direction along the Y axis. In other words, the terminal portion 61 of the upper pin 34A is arranged at a position corresponding to the terminal portion 61 of the lower pin 34B.

The other end portion of the extending portion 63 protrudes from the insulating part 32 in substantially the negative direction along the Y axis. The other end portion of the extending portion 63 may include a plurality of bent portions. The connecting portion 62 extends from the other end portion of the extending portion 63 in the negative direction along the Y axis. The connecting portion 62 is positioned outside the insulating part 32. The connecting portion 62 is covered with the attaching portion 42 of the housing 31. The connecting portion 62 may be positioned outside the attaching portion 42.

The connecting portions 62 of the plurality of upper pins 34A are arranged in the direction along the X axis. The connecting portions 62 of the plurality of lower pins 34B are also arranged in the direction along the X axis. The connecting portions 62 of the plurality of upper pins 34A and the connecting portions 62 of the plurality of lower pins 34B are arranged at substantially the same positions in the direction along the Z axis.

Figure 4:
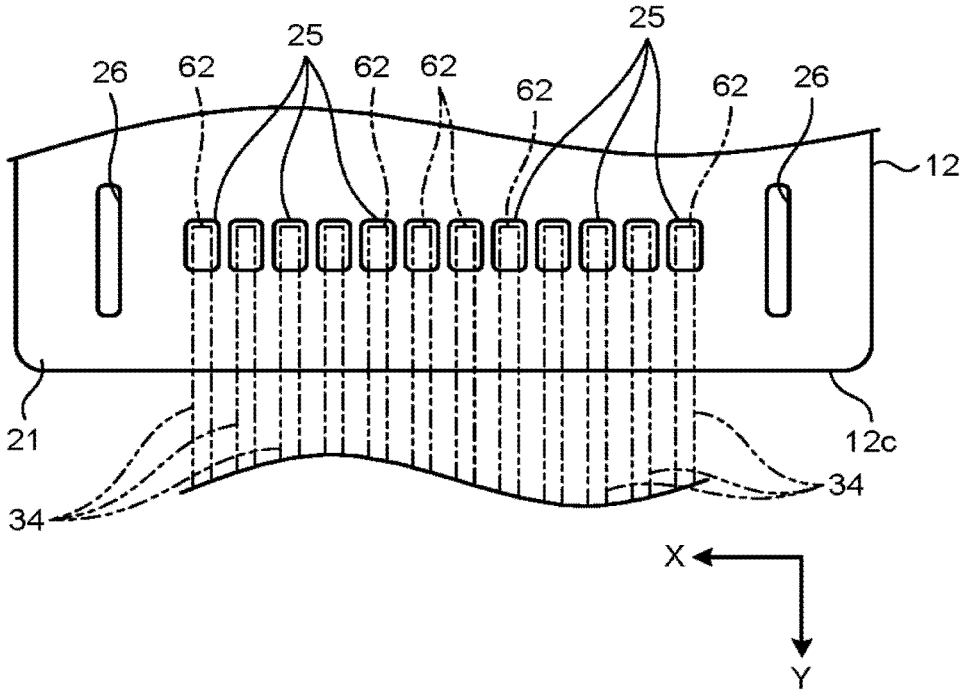
FIG. 4 is a plan view illustrating a part of the substrate and parts of a plurality of pins of the first embodiment.

FIG. 4 is a plan view illustrating a part of the substrate 12 and parts of the plurality of pins 34 of the first embodiment. In FIG. 4, the plurality of pins 34 are indicated by alternate long and two short dashes lines. In the first embodiment, the connecting portions 62 of the plurality of upper pins 34A and the connecting portions 62 of the plurality of lower pins 34B are arranged in a line as illustrated in FIG. 4.

As described above, the plurality of pins 34 are mounted in the plug 15. Each of the connecting portions 62 of the plurality of pins 34 is electrically connected to a corresponding pad 25, for example, by soldering.

The two protrusion walls 48 of the housing 31 are inserted into the two holes 26 of the substrate 12 as illustrated in FIG. 3. Each of the protrusion walls 48 is fixed to a corresponding hole 26, for example, by soldering. The housing 31 is electrically connected to a ground layer of the substrate 12, for example, through the protrusion wall 48.

The plug 15 is insertable into a socket 70 indicated by an alternate long and two short dashes line as illustrated in FIG. 1. The socket 70 is an example of a female connector, and may be also referred to as, for example, a connector, a receptacle, or a connecting unit. A direction where the plug 15 is inserted into the socket 70 lies along the Y axis.

In the first embodiment, the socket 70 is a USB connector complying with a USB Type-C standard. The socket 70 complies with a USB 3.1 Gen 2 standard. The socket 70 may comply with any other standard lower than or higher than a USB 3.1 Gen 2. The plug 15 may be insertable into a female connector complying with any other standard as long as it is insertable into the socket 70 complying with the USB Type-C standard.

For example, the socket 70 is mounted in a host device such as a portable computer, a tablet, a television receiver, a display, a smart phone, a mobile phone, or consumer electronics. The USB drive 10 can communicate with the host device through the plug 15 and the socket 70. The socket 70 may be mounted in other electronic devices such as a cable or an adapter for connecting a device with another device.

Figure 5:
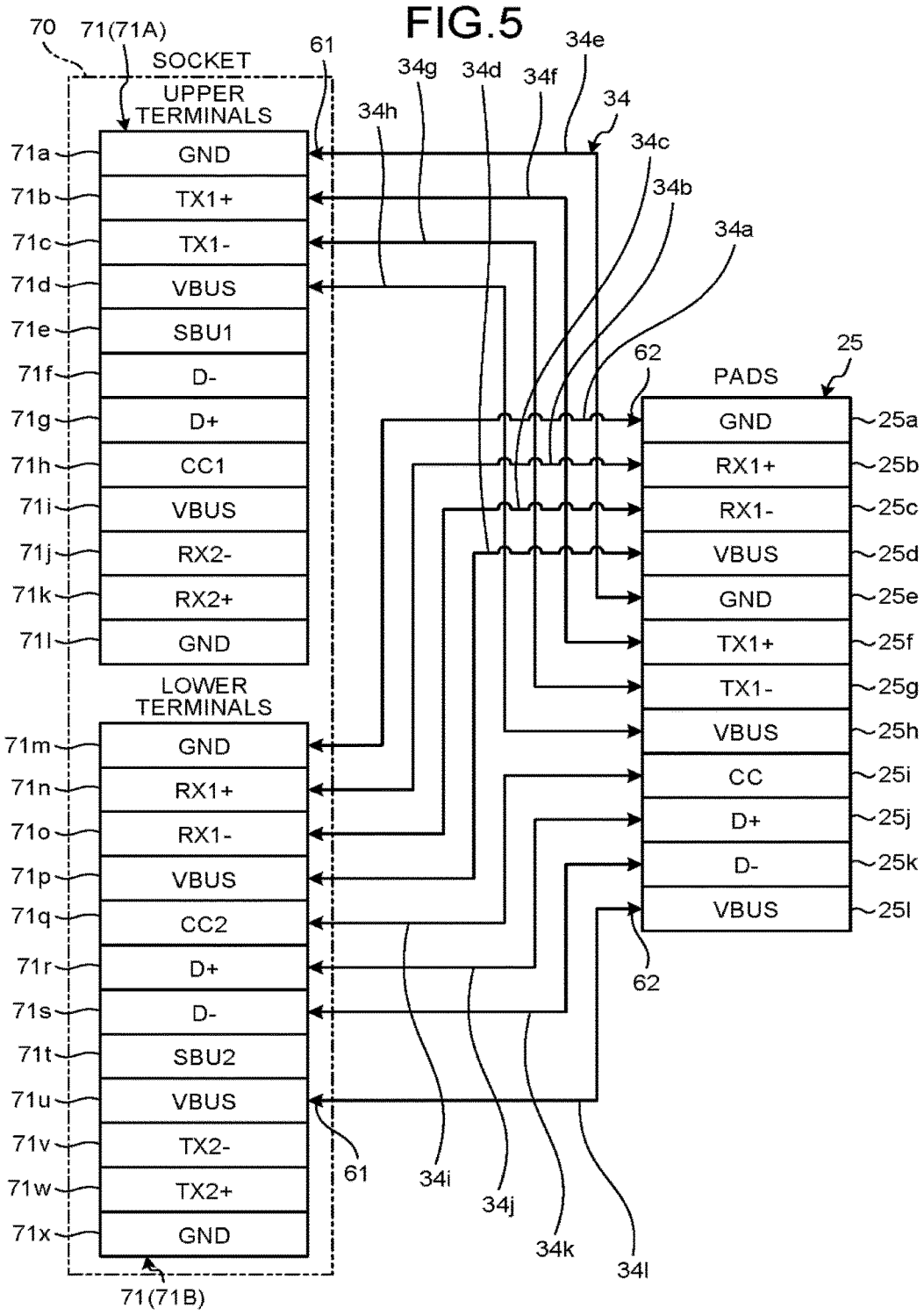
FIG. 5 is a view schematically illustrating an example of a connection among a plurality of pads, the plurality of pins, and a plurality of terminals of a socket of the first embodiment.
Figure 6:
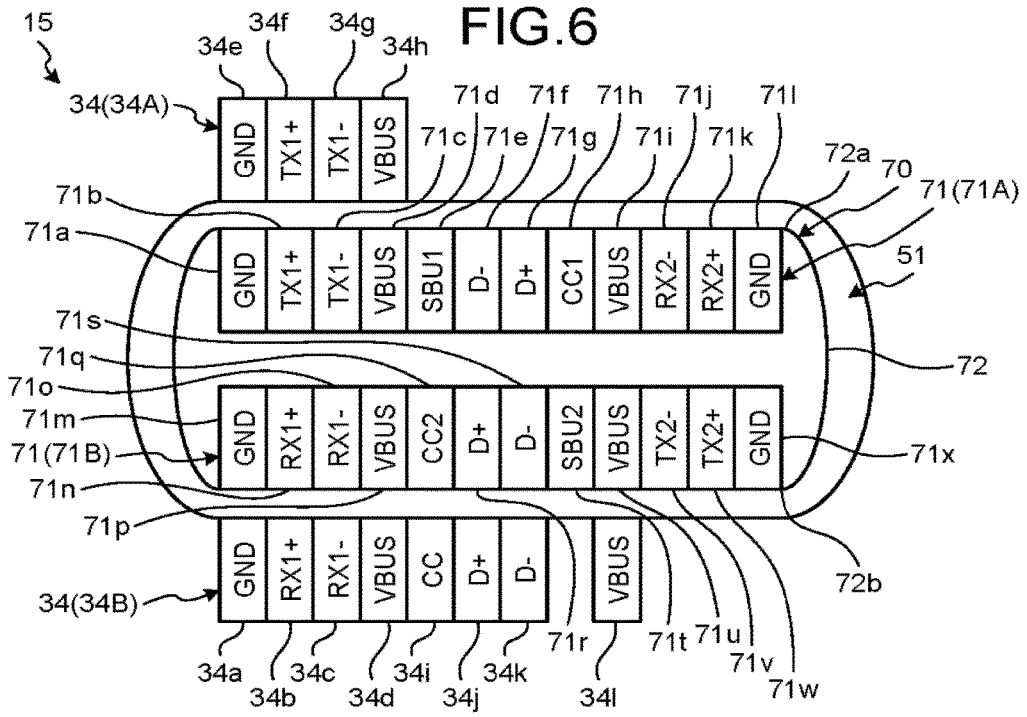
FIG. 6 is a front view schematically illustrating the plurality of terminals of a socket and the plurality of pins of the plug inserted into the socket of the first embodiment.
Figure 7:
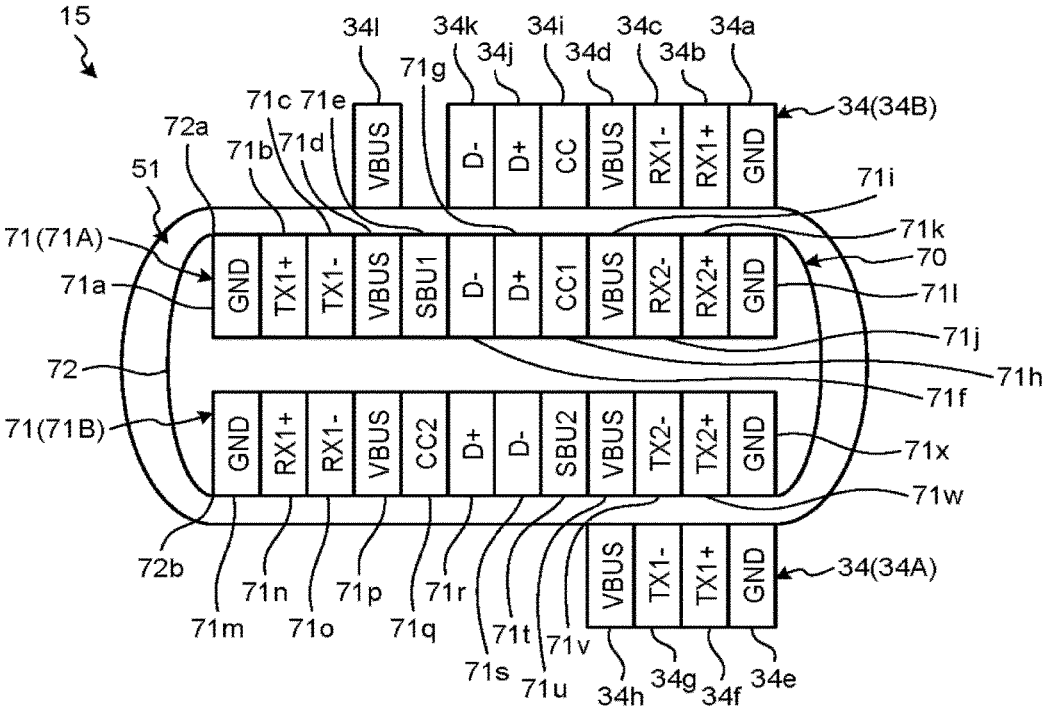
FIG. 7 is a front view schematically illustrating the plurality of terminals of the socket and the plurality of pins of the plug that are turned upside down and inserted into the socket of the first embodiment.

FIG. 5 is a view schematically illustrating an example of a connection among the plurality of pads 25, the plurality of pins 34, and a plurality of terminals 71 of the socket 70 of the first embodiment. FIG. 6 is a front view schematically illustrating the plurality of terminals 71 of the socket 70 and the plurality of pins 34 of the plug 15 inserted into the socket 70 of the first embodiment. FIG. 7 is a front view schematically illustrating the plurality of terminals 71 of the socket 70 and the plurality of pins 34 of the plug 15 that are turned upside down and inserted into the socket 70 of the first embodiment. The socket 70 includes the plurality of terminals 71 and an inserting unit 72 as illustrated in FIG. 6. In other words, the plurality of terminals 71 are mounted in the socket 70.

The inserting unit 72 is formed in a flat board shape which lies in the X-Y plane. The inserting unit 72 includes a first contact face 72*a* and a second contact face 72*b*. The second contact face 72*b* is positioned at the opposite side to the first contact face 72*a*. The plurality of terminals 71 are arranged on the first contact face 72*a* and the second contact face 72*b*.

When the plug 15 is inserted into the socket 70, the inserting unit 72 of the socket 70 is inserted into the insertion opening 51 of the plug 15. The inserting unit 72 is supported by the plurality of springs 33 of the plug 15.

The inserting unit 72 can be inserted into the insertion opening 51 with a first orientation in which the first contact face 72*a* faces the first inner face 32*a*, and the second contact face 72*b* faces the second inner face 32*b*. FIG. 6 illustrates the plug 15 and the socket 70 in the first orientation.

Further, the inserting unit 72 can be inserted into the insertion opening 51 with a second orientation in which the first contact face 72*a* faces the second inner face 32*b*, and the second contact face 72*b* faces the first inner face 32*a*. FIG. 7 illustrates the plug 15 and the socket 70 in the second orientation.

When the plug 15 is inserted into the socket 70, the terminal portions 61 of the plurality of pins 34 come into contact with the corresponding terminals 71. As a result, the plurality of pins 34 electrically connect at least one of the plurality of terminals 71 of the socket 70 with the plurality of pads 25 as schematically illustrated in FIG. 5. Further, the inserting unit 72 is supported by the plurality of upper pins 34A and the plurality of lower pins 34B. The terminal portion 61 illustrated in FIG. 2 is bent convexly toward the terminal 71 of the socket 70 that is inserted into the insertion opening 51.

The terminal 71 is made of a conductor such as metal. The plurality of terminals 71 include a plurality of upper terminals 71A and a plurality of lower terminals 71B. The names of the upper terminal 71A and the lower terminal 71B are given based on the positions of the upper terminal 71A and the lower terminal 71B in FIG. 6 for the sake of description and not intended to limit the positions of the upper terminal 71A and the lower terminal 71B. In the following description, a description for the terminal 71 is used as a description common to the upper terminal 71A and the lower terminal 71B.

The socket 70 complying with the USB Type-C standard includes 24 terminals 71. The twenty-four terminals 71 include twelve upper terminals 71A and twelve lower terminals 71B.

The plurality of upper terminals 71A are provided on the first contact face 72*a* and arranged in the direction along the X axis. As illustrated in FIG. 6, when the plug 15 is inserted into the socket 70 in the first orientation, the upper terminal 71A comes into contact with the terminal portion 61 of the corresponding upper pin 34A. As illustrated in FIG. 7, when the plug 15 is inserted into the socket 70 in the second orientation, the upper terminal 71A comes into contact with the terminal portion 61 of the corresponding lower pin 34B.

The plurality of lower terminals 71B are provided on the second contact face 72*b* and arranged in the direction along the X axis. As illustrated in FIG. 6, when the plug 15 is inserted into the socket 70 in the first orientation, the lower terminal 71B comes into contact with the terminal portion 61 of the corresponding lower pin 34B. As illustrated in FIG. 7, when the plug 15 is inserted into the socket 70 in the second orientation, the lower terminal 71B comes into contact with the terminal portion 61 of the corresponding upper pin 34A.

The plurality of lower terminals 71B are arranged at substantially the same positions as the plurality of upper terminals 71A in the direction along the Y axis. In other words, the upper terminal 71A is arranged at the position corresponding to the lower terminal 71B.

The plurality of upper terminals 71A include a ground (GND) terminal 71*a*, a first transmission differential signal positive (TX1+) terminal 71*b*, a first transmission differential signal negative (TX1−) terminal 71*c*, a power (VBUS) terminal 71*d*, a first sideband use (SBU1) terminal 71*e*, a differential signal negative (D−) terminal 71*f*, a differential signal positive (D+) terminal 71*g*, a first configuration channel signal (CC1) terminal 71*h*, a power (VBUS) terminal 71*i*, a second reception differential signal negative (RX2−) terminal 71*j*, a second reception differential signal positive (RX2+) terminal 71*k*, and a ground (GND) terminal 71*l*. The terminals 71*a* to 71*l* are arranged in the direction along the X axis in the described order.

Each of the VBUS terminals 71*d* and 71*i* is an example of a power terminal. Each of the GND terminals 71*a* and 71*l* is an example of a ground terminal. The D− terminal 71*f* and the D+ terminal 71*g* are an example of a pair of differential signal terminals. The TX1+ terminal 71*b* and the TX1− terminal 71*c* are an example of a pair of first transmission differential signal terminals. The CC1 terminal 71*h* is an example of a configuration channel signal terminal. The RX2− terminal 71*j* and the RX2+ terminal 71*k* are an example of a pair of second reception differential signal terminals.

The plurality of lower terminals 71B includes a ground (GND) terminal 71*m*, a first reception differential signal positive (RX1+) terminal 71*n*, a first reception differential signal negative (RX1−) terminal 71*o*, a power (VBUS) terminal 71*p*, a second configuration channel signal (CC2) terminal 71*q*, a differential signal positive (D+) terminal 71*r*, a differential signal negative (D−) terminal 71*s*, a second sideband use (SBU2) terminal 71*t*, a power (VBUS) terminal 71*u*, a second transmission differential signal negative (TX2−) terminal 71*v*, a second transmission differential signal positive (TX2+) terminal 71*w*, and a ground (GND) terminal 71*x*. The terminals 71*m* to 71*x* are arranged in the direction along the X axis in the described order.

Each of the VBUS terminals 71*p* and 71*u* is an example of a power terminal. Each of the GND terminals 71*m* and 71*x* is an example of a ground terminal. The D+ terminal 71*r* and the D− terminal 71*s* are an example of a pair of differential signal terminals. The RX1+ terminal 71*n* and the RX1− terminal 71*o* are an example of a pair of first reception differential signal terminals. The TX2− terminal 71*v* and the TX2+ terminal 71*w* are an example of a pair of second transmission differential signal terminals. The CC2 terminal 71*q* is an example of a configuration channel signal terminal.

The VBUS terminals 71*d*, 71*i*, 71*p*, and 71*u* and the GND terminals 71*a*, 71*l*, 71*m*, 71*x* are terminals for power supply. The D− terminals 71*f* and 71*s* and the D+ terminals 71*g* and 71*r* are terminals for data communication complying with the USB 2.0 standard. For example, the terminal 71*f*, 71*s*, 71*g*, and 71*r* are used for Low Speed communication, Full Speed communication, and High Speed communication in the USB standards. The TX1+ terminal 71*b*, the TX1− terminal 71*c*, the RX1+ terminal 71*n*, the RX1− terminal 71*o*, the RX2− terminal 71*j*, the RX2+ terminal 71*k*, the TX2− terminal 71*v*, and the TX2+ terminal 71*w* are terminals for data communication complying with the USB 3.0 standard, the USB 3.1 Gen 1 standard, and the USB 3.1 Gen 2 standard. For example, the terminals 71*b*, 71*c*, 71*n*, 71*o*, 71*j*, 71*k*, 71*v*, and 71*w* are used for SuperSpeed communication and SuperSpeedPlus communication in the USB standards.

The CC1 terminal 71*h* and the CC2 terminal 71*q* are terminals for detecting the insertion orientation of the plug 15. In other words, the CC1 terminal 71*h* and the CC2 terminal 71*q* are terminals for determining the orientation of the plug 15 inserted into the socket 70. For example, negotiation and the like for deciding a direction of power supply between connected devices, a setting of an electric current and a voltage, and a role of each terminal may be performed through communication using the CC1 terminal 71*h* and the CC2 terminal 71*q*.

The plug 15 may be mounted, for example, in a cable for connecting a plurality of devices. An ID chip may be mounted in the cable. The ID chip stores information according to a specification of a cable. When the cable is connected to the host device, the ID chip transmits information according to the specification of the cable to the host device. The host device determines whether or not communication with the cable and power supply are permitted based on the information. The CC1 terminal 71*h* and the CC2 terminal 71*q* may be used for transmitting information according to the specification of the cable.

In the direction along the Z axis, the GND terminal 71*a* overlaps the GND terminal 71*m*, the TX1+ terminal 71*b* overlaps the RX1+ terminal 71*n*, the TX1− terminal 71*c* overlaps the RX1− terminal 71*o*, the VBUS terminal 71*d* overlaps the VBUS terminal 71*p*, the SBU1 terminal 71*e* overlaps the CC2 terminal 71*q*, the D− terminal 71*f* overlaps the D+ terminal 71*r*, the D+ terminal 71*g* overlaps the D− terminal 71*s*, the CC1 terminal 71*h* overlaps the SBU2 terminal 71*t*, the VBUS terminal 71*i* overlaps the VBUS terminal 71*u*, the RX2− terminal 71*j* overlaps the TX2− terminal 71*v*, the RX2+ terminal 71*k* overlaps the TX2+ terminal 71*w*, and the GND terminal 71*l* overlaps the GND terminal 71*x*.

As illustrated in FIG. 5, in the first embodiment, the plurality of pads 25 include a ground (GND) pad 25*a*, a first reception differential signal positive (RX1+) pad 25*b*, a first reception differential signal negative (RX1−) pad 25*c*, a power (VBUS) pad 25*d*, a ground (GND) pad 25*e*, a first transmission differential signal positive (TX1+) pad 25*f*, a first transmission differential signal negative (TX1−) pad 25*g*, a power (VBUS) pad 25*h*, a configuration channel signal (CC) pad 25*i*, a differential signal positive (D+) pad 25*j*, a differential signal negative (D−) pad 25*k*, and a power (VBUS) pad 25*l*. The pads 25*a* to 25*l* are arranged in the direction along the X axis in the described order. The pads 25*a* to 25*l* may be arranged in a different order from the described order.

The VBUS pads 25*d*, 25*h*, and 25*l* are an example of a first conductor. The GND pads 25*a* and 25*e* are an example of a second conductor. The D+ pad 25*j* is an example of a third conductor. The D− pad 25*k* is an example of a fourth conductor. The TX1+ pad 25*f* is an example of a fifth conductor. The TX1− pad 25*g* is an example of a sixth conductor. The RX1+ pad 25*b* is an example of a seventh conductor. The RX1− pad 25*c* is an example of an eighth conductor. The CC pad 25*i* is an example of a ninth conductor.

In the first embodiment, the plurality of pins 34 include a ground (GND) pin 34*a*, a first reception differential signal positive (RX1+) pin 34*b*, a first reception differential signal negative (RX1−) pin 34*c*, a power (VBUS) pin 34*d*, a ground (GND) pin 34*e*, a first transmission differential signal positive (TX1+) pin 34*f*, a first transmission differential signal negative (TX1−) pin 34*g*, a power (VBUS) pin 34*h*, a configuration channel signal (CC) pin 34*i*, a differential signal positive (D+) pin 34*j*, a differential signal negative (D−) pin 34*k*, and a power (VBUS) pin 34*l*. As described above, the plurality of pins 34 are smaller in number than the plurality of terminals 71 of the socket 70 complying with the USB Type-C standard.

Each of the VBUS pins 34*d*, 34*h*, and 34*l* is an example of a first conductive member. Each of the GND pins 34*a* and 34*e* is an example of a second conductive member. The D+ pin 34*j* and the D− pin 34*k* are an example of a pair of third conductive members. The TX1+ pin 34*f* and the TX1− pin 34*g* are an example of a pair of fourth conductive members. The RX1+ pin 34*b* and the RX1− pin 34*c* are an example of a pair of fifth conductive members. The CC pin 34*i* is an example of a sixth conductive member.

The connecting portion 62 of the VBUS pin 34*d* is electrically connected to the VBUS pad 25*d*, for example, by soldering. The connecting portion 62 of the VBUS pin 34*d* is an example of a first contact portion. As described above, the VBUS pin 34*d* corresponds to the VBUS pad 25*d*.

FIG. 5 illustrates a connection among the plurality of pads 25, the plurality of pins 34, and the plurality of terminals 71 when the plug 15 is inserted into the socket 70 in the first orientation. As illustrated in FIG. 5, when the plug 15 is inserted into the socket 70 in the first orientation, the terminal portion 61 of the VBUS pin 34*d* comes into contact with the VBUS terminal 71*p* of the socket 70. The terminal portion 61 of the VBUS pin 34*d* is an example of the sixth contact portion and the first terminal portion. The VBUS pin 34*d* electrically connects the VBUS terminal 71*p* with the VBUS pad 25*d*. On the other hand, when the plug 15 is inserted into the socket 70 in the second orientation, the VBUS pin 34*d* in FIG. 7 electrically connects the VBUS terminal 71*i* of the socket 70 with the VBUS pad 25*d*.

The connecting portion 62 of the VBUS pin 34*h* in FIG. 5 is electrically connected to the VBUS pad 25*h*, for example, by soldering. The connecting portion 62 of the VBUS pin 34*h* is an example of a first contact portion. As described above, the VBUS pin 34*h* corresponds to the VBUS pad 25*h*.

When the plug 15 is inserted into the socket 70 in the first orientation, the terminal portion 61 of the VBUS pin 34*h* comes into contact with the VBUS terminal 71*d* of the socket 70. The terminal portion 61 of the VBUS pin 34*h* is an example of the sixth contact portion and the first terminal portion. The VBUS pin 34*h* electrically connects the VBUS terminal 71*d* with the VBUS pad 25*h*. On the other hand, when the plug 15 is inserted into the socket 70 in the second orientation, the VBUS pin 34*h* in FIG. 7 electrically connects the VBUS terminal 71*u* of the socket 70 with the VBUS pad 25*h*.

The connecting portion 62 of the VBUS pin 34*l* in FIG. 5 is electrically connected to the VBUS pad 25*l*, for example, by soldering. The connecting portion 62 of the VBUS pin 34*l* is an example of a first contact portion. As described above, the VBUS pin 34*l* corresponds to the VBUS pad 25*l*.

When the plug 15 is inserted into the socket 70 in the first orientation, the terminal portion 61 of the VBUS pin 34*l* comes into contact with the VBUS terminal 71*u* of the socket 70. The terminal portion 61 of the VBUS pin 34*l* is an example of the sixth contact portion and the first terminal portion. The VBUS pin 34*l* electrically connects the VBUS terminal 71*u* with the VBUS pad 25*l*. On the other hand, when the plug 15 is inserted into the socket 70 in the second orientation, the VBUS pin 34*l* in FIG. 7 electrically connects the VBUS terminal 71*d* of the socket 70 with the VBUS pad 25*l*.

The connecting portion 62 of the GND pin 34*a* in FIG. 5 is electrically connected to the GND pad 25*a*, for example, by soldering. The connecting portion 62 of the GND pin 34*a* is an example of a second contact portion. As described above, the GND pin 34*a* corresponds to the GND pad 25*a*.

When the plug 15 is inserted into the socket 70 in the first orientation, the terminal portion 61 of the GND pin 34*a* comes into contact with the GND terminal 71*m* of the socket 70. The terminal portion 61 of the GND pin 34*a* is an example of the seventh contact portion and the second terminal portion. The GND pin 34*a* electrically connects the GND terminal 71*m* with the GND pad 25*a*. On the other hand, when the plug 15 is inserted into the socket 70 in the second orientation, the GND pin 34*a* in FIG. 7 electrically connects the GND terminal 71*l* of the socket 70 with the GND pad 25*a*.

The connecting portion 62 of the GND pin 34*e* in FIG. 5 is electrically connected to the GND pad 25*e*, for example, by soldering. The connecting portion 62 of the GND pin 34*e* is an example of a second contact portion. As described above, the GND pin 34*e* corresponds to the GND pad 25*e*.

When the plug 15 is inserted into the socket 70 in the first orientation, the terminal portion 61 of the GND pin 34*e* comes into contact with the GND terminal 71*a* of the socket 70. The terminal portion 61 of the GND pin 34*e* is an example of the seventh contact portion and the second terminal portion. The GND pin 34*e* electrically connects the GND terminal 71*a* with the GND pad 25*e*. On the other hand, when the plug 15 is inserted into the socket 70 in the second orientation, the GND pin 34*e* in FIG. 7 electrically connects the GND terminal 71*x* of the socket 70 with the GND pad 25*e*.

The connecting portion 62 of the D+ pin 34*j* in FIG. 5 is electrically connected to the D+ pad 25*j*, for example, by soldering. The connecting portion 62 of the D+ pin 34*j* is an example of a third contact portion. As described above, the D+ pin 34*j* corresponds to the D+ pad 25*j*.

When the plug 15 is inserted into the socket 70 in the first orientation, the terminal portion 61 of the D+ pin 34*j* comes into contact with the D+ terminal 71*r* of the socket 70. The terminal portion 61 of the D+ pin 34*j* is an example of the eighth contact portion and the third terminal portion. The D+ pin 34*j* electrically connects the D+ terminal 71*r* with the D+ pad 25*j*. On the other hand, when the plug 15 is inserted into the socket 70 in the second orientation, the D+ pin 34*j* in FIG. 7 electrically connects the D+ terminal 71*g* of the socket 70 with the D+ pad 25*j*.

The connecting portion 62 of the D− pin 34*k* in FIG. 5 is electrically connected to the D− pad 25*k*, for example, by soldering. The connecting portion 62 of the D− pin 34*k* is an example of a third contact portion. As described above, the D− pin 34*k* corresponds to the D− pad 25*k*.

When the plug 15 is inserted into the socket 70 in the first orientation, the terminal portion 61 of the D− pin 34*k* comes into contact with the D− terminal 71*s* of the socket 70. The terminal portion 61 of the D− pin 34*k* is an example of the eighth contact portion and the third terminal portion. The D− pin 34*k* electrically connects the D− terminal 71*s* with the D− pad 25*k*. On the other hand, when the plug 15 is inserted into the socket 70 in the second orientation, the D− pin 34*k* in FIG. 7 electrically connects the D− terminal 71*f* of the socket 70 with the D− pad 25*k*.

The connecting portion 62 of the TX1+ pin 34*f* in FIG. 5 is electrically connected to the TX1+ pad 25*f*, for example, by soldering. The connecting portion 62 of the TX1+ pin 34*f* is an example of a fourth contact portion. As described above, the TX1+ pin 34*f* corresponds to the TX1+ pad 25*f*.

When the plug 15 is inserted into the socket 70 in the first orientation, the terminal portion 61 of the TX1+ pin 34*f* comes into contact with the TX1+ terminal 71*b* of the socket 70. The terminal portion 61 of the TX1+ pin 34*f* is an example of a ninth contact portion. The TX1+ pin 34*f* electrically connects the TX1+ terminal 71*b* with the TX1+ pad 25*f*. On the other hand, when the plug 15 is inserted into the socket 70 in the second orientation, the TX1+ pin 34*f* in FIG. 7 electrically connects the TX2+ terminal 71*w* of the socket 70 with the TX1+ pad 25*f*.

The connecting portion 62 of the TX1− pin 34*g* in FIG. 5 is electrically connected to the TX1− pad 25*g*, for example, by soldering. The connecting portion 62 of the TX1− pin 34*g* is an example of a fourth contact portion. As described above, the TX1− pin 34*g* corresponds to the TX1− pad 25*g*.

When the plug 15 is inserted into the socket 70 in the first orientation, the terminal portion 61 of the TX1− pin 34*g* comes into contact with the TX1− terminal 71*c* of the socket 70. The terminal portion 61 of the TX1− pin 34*g* is an example of a ninth contact portion. The TX1− pin 34*g* electrically connects the TX1− terminal 71*c* with the TX1− pad 25*g*. On the other hand, when the plug 15 is inserted into the socket 70 in the second orientation, the TX1− pin 34*g* in FIG. 7 electrically connects the TX2− terminal 71*v* of the socket 70 with the TX1− pad 25*g*.

The connecting portion 62 of the RX1+ pin 34*b* in FIG. 5 is electrically connected to the RX1+ pad 25*b*, for example, by soldering. The connecting portion 62 of the RX1+ pin 34*b* is an example of a fifth contact portion. As described above, the RX1+ pin 34*b* corresponds to the RX1+ pad 25*b*.

When the plug 15 is inserted into the socket 70 in the first orientation, the terminal portion 61 of the RX1+ pin 34*b* comes into contact with the RX1+ terminal 71*n* of the socket 70. The terminal portion 61 of the RX1+ pin 34*b* is an example of a tenth contact portion. The RX1+ pin 34*b* electrically connects the RX1+ terminal 71*n* with the RX1+ pad 25*b*. On the other hand, when the plug 15 is inserted into the socket 70 in the second orientation, the RX1+ pin 34*b* in FIG. 7 electrically connects the RX2+ terminal 71*k* of the socket 70 with the RX1+ pad 25*b*.

The connecting portion 62 of the RX1− pin 34*c* in FIG. 5 is electrically connected to the RX1− pad 25*c*, for example, by soldering. The connecting portion 62 of the RX1− pin 34*c* is an example of a fifth contact portion. As described above, the RX1− pin 34*c* corresponds to the RX1− pad 25*c*.

When the plug 15 is inserted into the socket 70 in the first orientation, the terminal portion 61 of the RX1− pin 34*c* comes into contact with the RX1− terminal 71*o* of the socket 70. The terminal portion 61 of the RX1− pin 34*c* is an example of a tenth contact portion. The RX1− pin 34*c* electrically connects the RX1− terminal 71*o* with the RX1− pad 25*c*. On the other hand, when the plug 15 is inserted into the socket 70 in the second orientation, the RX1− pin 34*c* in FIG. 7 electrically connects the RX2− terminal 71*j* of the socket 70 with the RX1− pad 25*c*.

The connecting portion 62 of the CC pin 34*i* in FIG. 5 is electrically connected to the CC pad 25*i*, for example, by soldering. The connecting portion 62 of the CC pin 34*i* is an example of an eleventh contact portion. As described above, the CC pin 34*i* corresponds to the CC pad 25*i*.

When the plug 15 is inserted into the socket 70 in the first orientation, the terminal portion 61 of the CC pin 34*i* comes into contact with and is electrically connected to the CC2 terminal 71*q* of the socket 70. The CC pin 34*i* electrically connects the CC2 terminal 71*q* with the CC pad 25*i*. On the other hand, when the plug 15 is inserted into the socket 70 in the second orientation, the CC pin 34*i* in FIG. 7 electrically connects the CC1 terminal 71*h* of the socket 70 with the CC pad 25*i*.

As illustrated in FIGS. 5 and 6, the plurality of pins 34 of the first embodiment include no pins 34 that electrically connect the VBUS terminal 71*i*, the GND terminals 71*i* and 71*x*, the D+ terminal 71*g*, the D− terminal 71*f*, the TX2+ terminal 71*w*, the TX2− terminal 71*v*, the RX2+ terminal 71*k*, the RX2− terminal 71*j*, the CC1 terminal 71*h*, the SBU1 terminal 71*e*, and the SBU2 terminal 71*t* with the pads 25 when the plug 15 is inserted into the socket 70 in the first orientation.

For example, the plurality of pins 34 may include other pins 34 such as a pin 34 that connects the SBU1 terminal 71*e* with the pad 25 when the plug 15 is inserted into the socket 70 and a pin 34 that connects the SBU2 terminal 71*t* with the pad 25 when the plug 15 is inserted into the socket 70.

The insulating part 32 of the plug 15 is positioned between the substrate 12 and each of the VBUS terminal 71*i*, the GND terminals 71*l* and 71*x*, the D+ terminal 71*g*, the D− terminal 71*f*, the TX2+ terminal 71*w*, the TX2− terminal 71*v*, the RX2+ terminal 71*k*, the RX2− terminal 71*j*, the CC1 terminal 71*h*, the SBU1 terminal 71*e*, and the SBU2 terminal 71*t* when the plug 15 is inserted into the socket 70 in the first orientation. In other words, the insulating part 32 of the plug 15 electrically separates each of the VBUS terminal 71*i*, the GND terminals 71*l* and 71*x*, the D+ terminal 71*g*, the D− terminal 71*f*, the TX2+ terminal 71*w*, the TX2− terminal 71*v*, the RX2+ terminal 71*k*, the RX2− terminal 71*j*, the CC1 terminal 71*h*, the SBU1 terminal 71*e*, and the SBU2 terminal 71*t* from the substrate 12 when the plug 15 is inserted into the socket 70 in the first orientation.

Further, the insulating part 32 of the plug 15 electrically separates each of the VBUS terminal 71*p*, the GND terminals 71*a* and 71*m*, the D+ terminal 71*r*, the D− terminal 71*s*, the TX1+ terminal 71*b*, the TX1− terminal 71*c*, the RX1+ terminal 71*n*, the RX1− terminal 71*o*, the CC2 terminal 71*q*, the SBU1 terminal 71*e*, and the SBU2 terminal 71*t* from the substrate 12 when the plug 15 is inserted into the socket 70 in the second orientation.

The plug 15 may include members that come into contact with the VBUS terminal 71*i*, the GND terminals 71*l* and 71*x*, the D+ terminal 71*g*, the D− terminal 71*f*, the TX2+ terminal 71*w*, the TX2− terminal 71*v*, the RX2+ terminal 71*k*, the RX2− terminal 71*j*, the CC1 terminal 71*h*, the SBU1 terminal 71*e*, and the SBU2 terminal 71*t* when the plug 15 is inserted into the socket 70 in the first orientation. For example, the plug 15 may include pins that come into contact with the corresponding terminals 71*e*, 71*f*, 71*g*, 71*h*, 71*i*, 71*j*, 71*k*, 71*l*, 71*t*, 71*v*, 71*w*, and 71*x* when the plug 15 is inserted into the socket 70 in the first orientation and are electrically separated from the substrate 12.

As illustrated in FIG. 4, in the first embodiment, the connecting portions 62 of the plurality of pins 34 including the GND pin 34*a*, the RX1+ pin 34*b*, the RX1− pin 34*c*, the VBUS pin 34*d*, the GND pin 34*e*, the TX1+ pin 34*f*, the TX1− pin 34*g*, the VBUS pin 34*h*, the CC pin 34*i*, the D+ pin 34*j*, the D− pin 34*k*, and the VBUS pin 34*l* are arranged in a line. The connecting portions 62 of the pins 34*a* to 34*l* are arranged in the direction along the X axis in the above-described order. The connecting portions 62 of the pins 34*a* to 34*l* may be arranged in a different order from the above-described order. The arrangement of the connecting portions 62 of the pins 34*a* to 34*l* is the same as the arrangement of the plurality of pads 25*a* to 25*l* illustrated in FIG. 5.

The connecting portion 62 of the D+ pin 34*j* is adjacent to the connecting portion 62 of the D− pin 34*k*. The connecting portion 62 of the D+ pin 34*j* and the connecting portion 62 of the D− pin 34*k* are positioned between the connecting portion 62 of the CC pin 34*i* and the connecting portion 62 of the VBUS pin 34*l*.

The connecting portion 62 of the TX1+ pin 34*f* is adjacent to the connecting portion 62 of the TX1− pin 34*g*. The connecting portion 62 of the TX1+ pin 34*f* and the connecting portion 62 of the TX1− pin 34*g* are positioned between the connecting portion 62 of the GND pin 34*e* and the connecting portion 62 of the VBUS pin 34*h*.

The connecting portion 62 of the RX1+ pin 34*b* is adjacent to the connecting portion 62 of the RX1− pin 34*c*. The connecting portion 62 of the RX1+ pin 34*b* and the connecting portion 62 of the RX1− pin 34*c* are positioned between the connecting portion 62 of the GND pin 34*a* and the connecting portion 62 of the VBUS pin 34*d*.

The two connecting portions 62 of the VBUS pin 34*h* and the CC pin 34*i* are arranged between the two connecting portions 62 of the D+ pin 34*j* and the D− pin 34*k* and the two connecting portions 62 of the TX1+ pin 34*f* and the TX1− pin 34*g*. The two connecting portions 62 of the VBUS pin 34*d* and the GND pin 34*e* are arranged between the two connecting portions 62 of the TX1+ pin 34*f* and the TX1− pin 34*g* and the two connecting portions 62 of the RX1+ pin 34*b* and the RX1− pin 34*c*.

As illustrated in FIG. 6, in the first embodiment, the terminal portion 61 of the D+ pin 34*j* is adjacent to the terminal portion 61 of the D− pin 34*k*. The terminal portion 61 of the CC pin 34*i* is adjacent to the terminal portion 61 of the D+ pin 34*j*.

The terminal portion 61 of the TX1+ pin 34*f* is adjacent to the terminal portion 61 of the TX1− pin 34*g*. The terminal portion 61 of the TX1+ pin 34*f* and the terminal portion 61 of the TX1− pin 34*g* are positioned between the terminal portion 61 of the GND pin 34*e* and the terminal portion 61 of the VBUS pin 34*h*.

The terminal portion 61 of the RX1+ pin 34*b* is adjacent to the terminal portion 61 of the RX1− pin 34*c*. The terminal portion 61 of the RX1+ pin 34*b* and the terminal portion 61 of the RX1− pin 34*c* are positioned between the terminal portion 61 of the GND pin 34*a* and the terminal portion 61 of the VBUS pin 34*d*.

Figure 8:
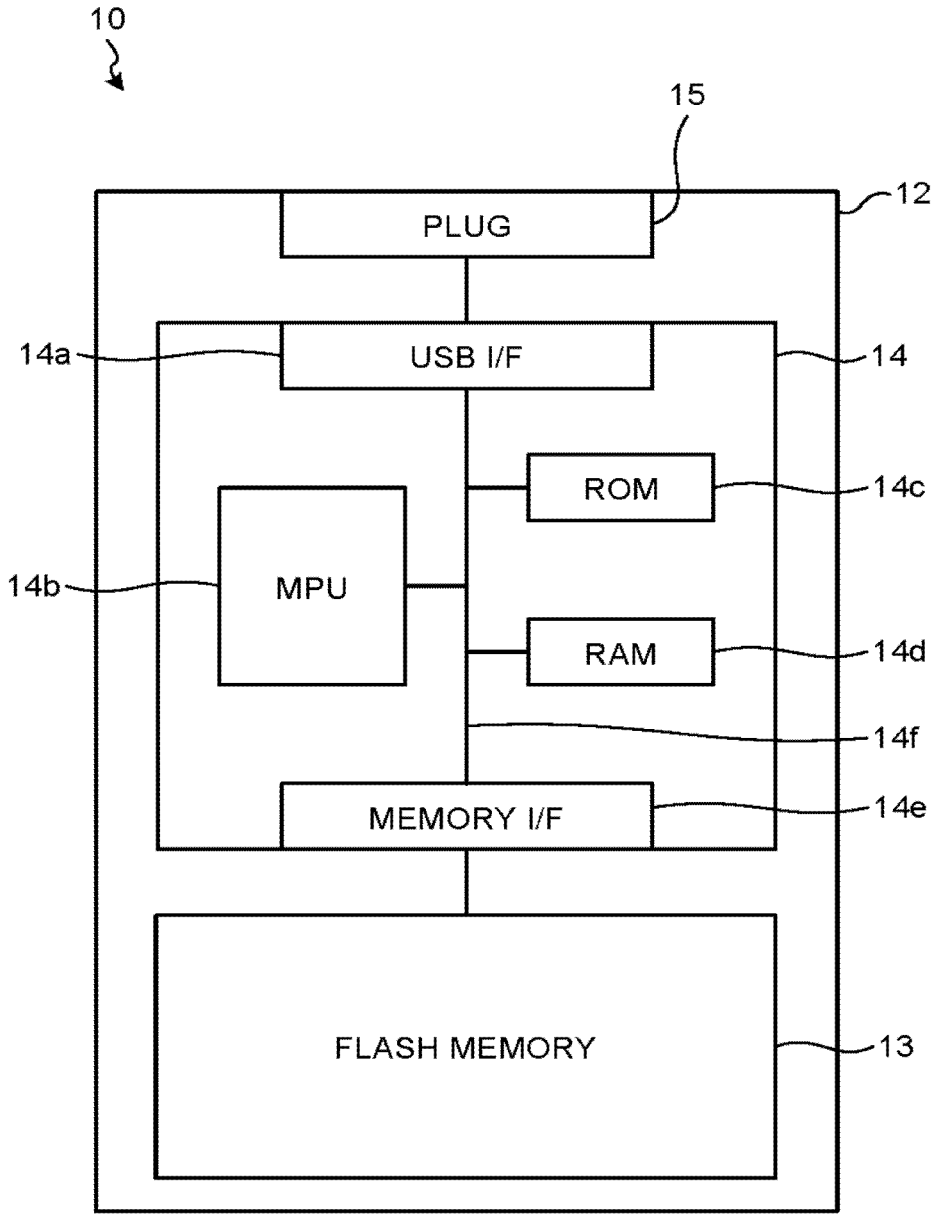
FIG. 8 is a block diagram illustrating an exemplary configuration of the USB drive of the first embodiment.

FIG. 8 is a block diagram illustrating an example of a configuration of the USB drive 10 of the first embodiment. The controller 14 controls transmission of data between the plug 15 and the flash memory 13 as illustrated in FIG. 8. The controller 14 includes a USB interface (I/F) 14*a*, an MPU 14*b*, a ROM 14*c*, a RAM 14*d*, a memory interface (I/F) 14*e*, and an internal bus 14*f*. The USB I/F 14*a*, the MPU 14*b*, the ROM 14*c*, the RAM 14*d*, the memory I/F 14*e*, and the internal bus 14*f* are formed, for example, on one semiconductor substrate.

The USB I/F 14*a* receives data and a command from the host device through the plug 15. For example, the data and the command are written according to a standard format of a small computer system interface (SCSI). The USB I/F 14*a* outputs data read from the flash memory 13 to the host device through the plug 15 according to the standard format of the SCSI.

The MPU 14*b* processes the command received from the host device and the data received from the flash memory 13, for example, using the ROM 14*c* and the RAM 14*d*. The MPU 14*b* performs an authentication process between the host device and the USB drive 10 when the USB drive 10 is connected to the host device.

The ROM 14*c* holds, for example, data and a program necessary for the process in the MPU 14*b*. The RAM 14*d* functions a work area in the process of the MPU 14*b*. The RAM 14*d* is, for example, a volatile semiconductor memory such as a DRAM.

The memory I/F 14*e* is connected to the flash memory 13, for example, through a plurality of wirings. The memory I/F 14*e* transfers the command and the data received through the USB I/F 14*a* to the flash memory 13 and the data read from the flash memory 13 to the USE I/F 14*a*, respectively, according to a command of the MPU 14*b*.

The flash memory 13 reads and outputs data according to a read command given from the controller 14. The flash memory 13 records data according to a write command given from the controller 14.

As illustrated in FIGS. 5 to 7, when the plug 15 is inserted into the socket 70, the D+ pin 34*j*, the D− pin 34*k*, the TX1+ pin 34*f*, the TX1− pin 34*g*, the RX1+ pin 34*b*, and the RX1− pin 34*c* electrically connect one of the D+ terminals 71*g* and 71*r*, one of the D− terminals 71*f* and 71*s*, one of the TX1+ terminal 71*b* and the TX2+ terminal 71*w*, one of the TX1− terminal 71*c* and the TX2− terminal 71*v*, one of the RX1+ terminal 71*n* and the RX2+ terminal 71*k*, and one of the RX1− terminal 71*o* and the RX2− terminal 71*j* with the D+ pad 25*j*, the D− pad 25*k*, the TX1+ pad 25*f*, the TX1− pad 25*g*, the RX1+ pad 25*b*, and the RX1− pad 25*c*. Thus, the USB drive 10 and the host device can perform data communication complying with the USB 3.0 standard and the USE 3.1 Gen 1 standard. For example, the USB drive 10 and the host device can perform SuperSpeed data communication.

In general, a male connector complying with the USB Type-C standard includes twenty-four pins. For this reason, intervals between connecting portions of pins are narrow, and intervals between a plurality of pads electrically connected to the connecting portions are narrow. There are cases in which a plurality of pads and the connecting portions of the pins connected to the pads are arranged in two lines. In this case, the pads and the connecting portions of the pins in one of the lines are hidden by the pads and the connecting portions of the pins in the other of the lines, and it may be difficult to view a connection state between the pads and the connecting portions of the pins.

On the other hand, in the USB drive 10 according to the first embodiment, when the plug 15 is inserted into the socket 70, each of the plurality of pins 34 electrically connects one of the plurality of terminals 71 of the socket 70 with one of the plurality of pads 25. The number of the plurality of pins 34 is less than twenty-four, and is smaller than the number of the plurality of terminals 71 of the socket 70 complying with the USB Type-C standard. Thus, since the number of pads 25 electrically connected with the pins 34 is reduced, a decrease in the intervals between the plurality of pads 25 is suppressed, and the occurrence of a trouble in an electrical connection between the pad 25 and the pin 34 is suppressed.

The plug 15 electrically separates the TX1+ terminal 71*b* and the TX1− terminal 71*c* or the TX2+ terminal 71*w* and the TX2− terminal 71*v* of the socket 70 from the substrate 12. The plug 15 electrically separates the RX1+ terminal 71*n* and the RX1− terminal 71*o* or the RX2+ terminal 71*k* and the RX2− terminal 71*j* from the substrate 12. Thus, the pins 34 that electrically connect the terminals 71*b* and 71*c* or the terminals 71*w* and 71*v* with the substrate 12 are unnecessary. Further, the pins 34 that electrically connect the terminals 71*n* and 71*o* or the terminals 71*k* and 71*j* with the substrate 12 are unnecessary. Thus, the number of pins 34 is reduced to be smaller than that of the male connector complying with the USB Type-C standard. A decrease in the intervals between the plurality of pads 25 is suppressed, and the occurrence of a trouble in an electrical connection between the pad 25 and the pin 34 is suppressed.

The connecting portions 62 of the GND pin 34*a*, the RX1+ pin 34*b*, the RX1− pin 34*c*, the VBUS pin 34*d*, the GND pin 34*e*, the TX1+ pin 34*f*, the TX1− pin 34*g*, the VBUS pin 34*h*, the CC pin 34*i*, the D+ pin 34*j*, the D−pin 34*k*, and the VBUS pin 34*l* are arranged in a line. Thus, it is suppressed that a connection state between the pads 25 and the connecting portions 62 of the pins 34*a* to 34*l* is hardly viewed. Thus, an electrical connection between the pads 25 and the connecting portions 62 of the pins 34*a* to 34*l* is suppressed from being insufficiently maintained.

The connecting portions 62 of the GND pin 34*e* and the VBUS pin 34*d* 34*h* are arranged in a space between the connecting portions 62 of the D+ pin 34*j* and the D− pin 34*k* and the connecting portions 62 of the TX1+ pin 34*f* and the TX1− pin 34*g*, and a space between the connecting portions 62 of the TX1+ pin 34*f* and the TX1− pin 34*g* and the connecting portions 62 of the RX1+ pin 34*b* and the RX1− pin 34*c*. Thus, it is suppressed that differential signals flowing through one pair of the pins 34*b* and 34*c*, the pins 34*f* and 34*g*, and the pins 34*j* and 34*k* are influenced by the other pins of the pins 34*b* and 34*c*, the pins 34*f* and 34*g*, and the pins 34*j* and 34*k*.

The connecting portions 62 of the TX1+ pin 34*f* and the TX1− pin 34*g* are positioned between the connecting portion 62 of the GND pin 34*e* and the connecting portion 62 of the VBUS pin 34*h*. The connecting portions 62 of the RX1+ pin 34*b* and the RX1− pin 34*c* are positioned between the connecting portion 62 of the GND pin 34*a* and the connecting portion 62 of the VBUS pin 34*d*. Thus, it is suppressed that a differential signal flowing through one of the pins 34*b*, 34*c*, 34*f*, and 34*g* is influenced by the other pins of the pins 34*b*, 34*c*, 34*f*, and 34*g*.

The terminal portions 61 of the TX1+ pin 34*f* and the TX1− pin 34*g* are positioned between the terminal portion 61 of the GND pin 34*e* and the terminal portion 61 of the VBUS pin 34*h*. The terminal portions 61 of RX1+ pin 34*b* and the RX1− pin 34*c* are positioned between the terminal portion 61 of the GND pin 34*a* and the terminal portion 61 of the VBUS pin 34*d*. In other words, an arrangement of the terminal portions 61 of the pins 34*e*, 34*f*, 34*g*, and 34*h* is the same as the arrangement of the connecting portions 62 of the pins 34*e*, 34*f*, 34*g*, and 34*h*. Further, an arrangement of the terminal portions 61 of the pins 34*a*, 34*b*, 34*c*, and 34*d* is the same as the arrangement of the connecting portion 62 of the pins 34*a*, 34*b*, 34*c*, and 34*d*. Thus, paths of the pins 34 can be easily designed. In addition, deterioration in characteristics of signals flowing through the pins 34*e*, 34*f*, 34*g*, and 34*h* is suppressed.

The connecting portions 62 of the D+ pin 34*j* and the D− pin 34*k* are positioned between the connecting portion 62 of the CC pin 34*i* and the connecting portion 62 of the VBUS pin 34*l*. Thus, the TX1+ pin 34*f*, the TX1− pin 34*g*, the RX1+ pin 34*b*, and the RX1− pin 34*c* are prevented from having influence on the differential signals flowing through the D+ pin 34*j* and the D− pin 34*k*.

Figure 9:
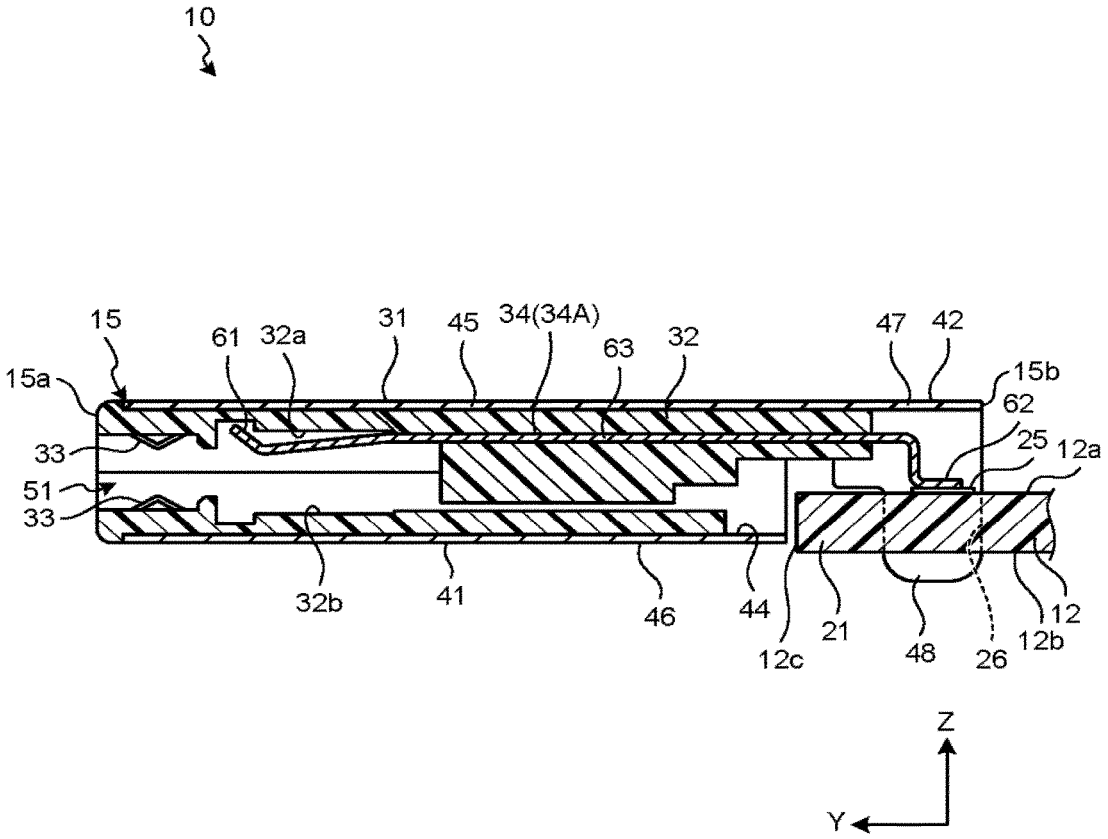
FIG. 9 is a cross-sectional view schematically illustrating a part of a USB drive according to a first modified example of the first embodiment.

FIG. 9 is a cross-sectional view schematically illustrating a part of the USB drive 10 according to a first modified example of the first embodiment. The plurality of pins 34 according to the first modified example include upper pins 34A but do not include lower pins 34B as illustrated in FIG. 9. The plurality of pins 34 may include lower pins 34B but may not include upper pins 34A.

The upper pins 34A include a GND pin 34*a*, an RX1+ pin 34*b*, an RX1− pin 34*c*, a VBUS pin 34*d*, a GND pin 34*e*, a TX1+ pin 34*f*, a TX1− pin 34*g*, a VBUS pin 34*h*, a CC pin 34*i*, a D+ pin 34*j*, a D− pin 34*k*, and a VBUS pin 34*l*. The terminal portions 61 of the pins 34*a* to 34*l* are arranged in a line.

In the first modified example of the first embodiment, the terminal portions 61 of the D+ pin 34*j*, the D− pin 34*k*, the TX1+ pin 34*f*, the TX1− pin 34*g*, the RX1+ pin 34*b*, and the RX1− pin 34*c* are arranged in a line. Further, the connecting portions 62 of the pins 34*b*, 34*c*, 34*f*, 34*g*, 34*j*, and 34*k* are arranged in a line as well. In other words, the lengths of the pins 34*b*, 34*c*, 34*f*, 34*g*, 34*j*, and 34*k* in the direction along the Y axis are substantially equal. Thus, for example, the pins 34*b*, 34*c*, 34*f*, 34*g*, 34*j*, and 34*k* can be made by a mold from one metallic plate. Accordingly, the pins 34*b*, 34*c*, 34*f*, 34*g*, 34*j*, and 34*k* can be easily made.

Figure 10:
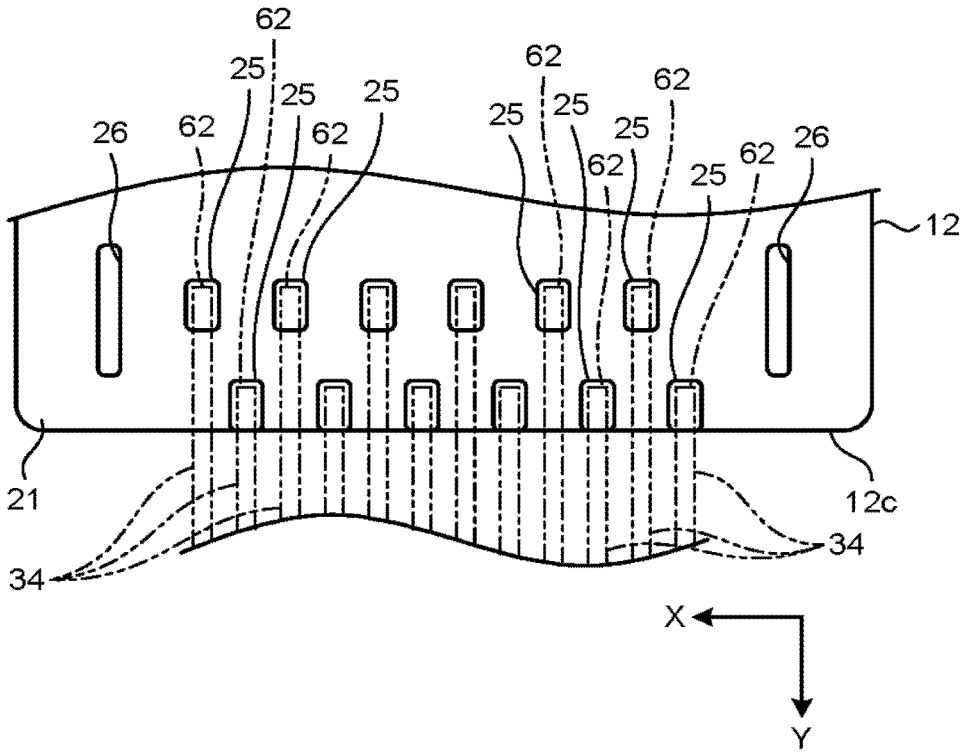
FIG. 10 is a plan view illustrating a part of a substrate and pars of a plurality of pins according to a second modified example of the first embodiment.

FIG. 10 is a plan view illustrating a part of the substrate 12 and parts of the plurality of pins 34 according to a second modified example of the first embodiment. The plurality of pads 25 are arranged in two lines as illustrated in FIG. 10. The connecting portions 62 of the plurality of pins 34 are arranged in two lines as well.

Each of the two lines of the plurality of pads 25 extends in the direction along the X axis. The pads 25 included in one of the two lines and the pads 25 included in the other of the two lines are arranged to alternate with each other in the direction along the X axis. The positions of several pads 25 included in one of the two lines among the plurality of pads 25 are different from and do not overlap with the positions of several pads 25 included in the other of the two lines among the plurality of pads 25 in the direction along the Y axis.

Similarly, each of the two lines of the connecting portions 62 of the plurality of pins 34 extends in the direction along the X axis. The connecting portions 62 of the pins 34 included in one of the two lines and the connecting portion 62 of the pins 34 included in the other of the two lines are arranged to alternate with each other in the direction along the X axis. The positions of several connecting portions 62 included in one of the two lines among a plurality of connecting portions 62 are different from and do not overlap with the positions of several connecting portions 62 included in the other of the two lines among a plurality of connecting portions 62 in the direction along the Y axis.

In the second modified example of the first embodiment, the connecting portions 62 of the plurality of pins 34 including the D+ pin 34*j*, the D− pin 34*k*, the TX1+ pin 34*f*, the TX1− pin 34*g*, the RX1+ pin 34*b*, and the RX1− pin 34*c* are arranged in two lines. Thus, since the number of pins 34 in each line is reduced, a decrease in the intervals between the plurality of pads 25 is suppressed. Accordingly, the occurrence of a trouble in an electric connection between the pads 25 and the connecting portions 62 of the pins 34*b*, 34*c*, 34*f*, 34*g*, 34*j*, and 34*k* is suppressed.

The connecting portions 62 of the D+ pin 34*j*, the D− pin 34*k*, the TX1+ pin 34*f*, the TX1− pin 34*g*, the RX1+ pin 34*b*, and the RX1− pin 34*c* included in one of the two lines are arranged to alternate with the connecting portions 62 of the pins 34*b*, 34*c*, 34*f*, 34*g*, 34*j*, and 34*k* included in the other of the two lines. Thus, the pads 25 and the connecting portions 62 of the pins 34*b*, 34*c*, 34*f*, 34*g*, 34*j*, and 34*k* in one of the lines are prevented from being hidden by the pads 25 and the connecting portions 62 of the pins 34*b*, 34*c*, 34*f*, 34*g*, 34*j*, and 34*k* in the other of the lines. Accordingly, an electrical connection between the pads 25 and the connecting portions 62 of the pins 34*b*, 34*c*, 34*f*, 34*g*, 34*j*, and 34*k* is suppressed from being insufficiently maintained.

Figure 11:
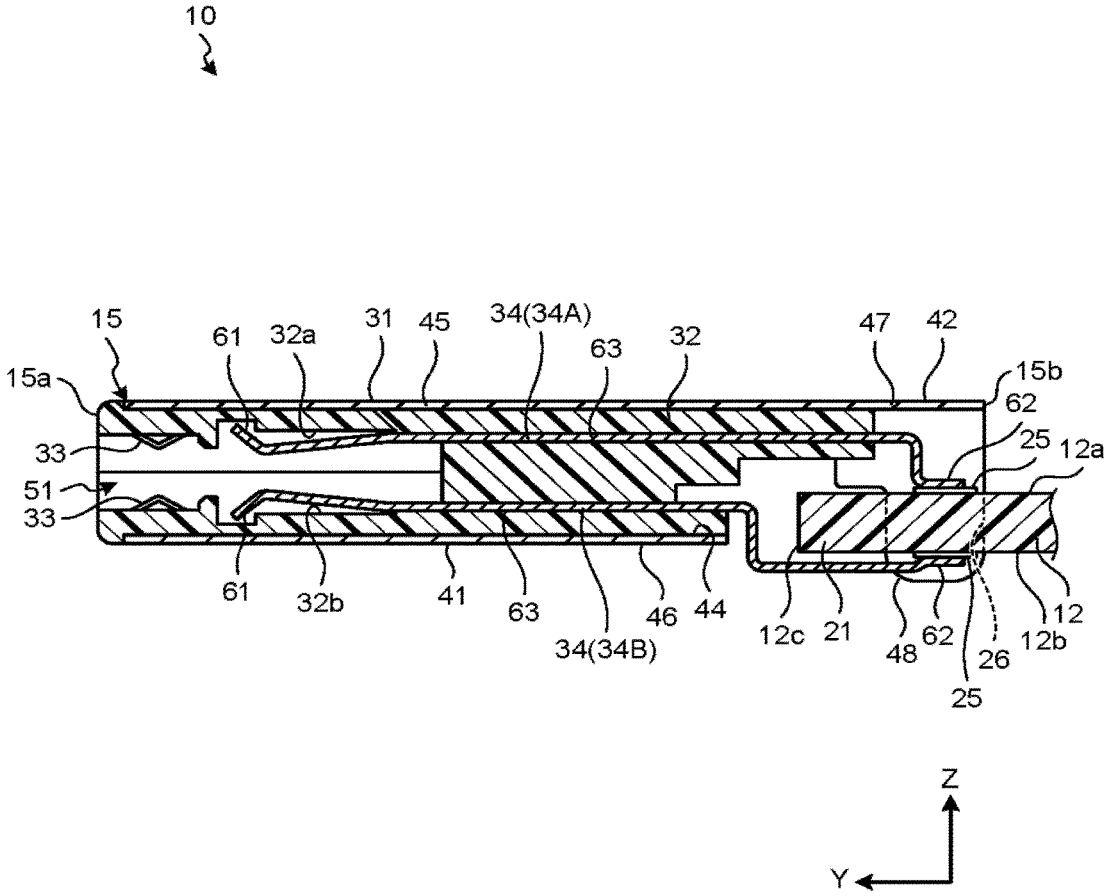
FIG. 11 is a cross-sectional view schematically illustrating a part of a USB drive according to a third modified example of the first embodiment.

FIG. 11 is a cross-sectional view schematically illustrating a part of the USB drive 10 according to a third modified example of the first embodiment. As illustrated in FIG. 11, the plurality of pads 25 according to the third modified example are mounted on a first face 12*a* and a second face 12*b* of the substrate 12.

The plurality of pads 25 arranged on the first face 12*a* are arranged in a line in the direction along the X axis. The plurality of pads 25 arranged on the second face 12*b* are arranged in a line in the direction along the X axis. The plurality of pads 25 arranged on the first face 12*a* and the plurality of pads 25 arranged on the second face 12*b* may be arranged at substantially the same positions or may be arranged at different positions in the direction along the Y axis.

The connecting portions 62 of the upper pins 34A are electrically connected to the pads 25 arranged on the first face 12*a*. The connecting portions 62 of the lower pins 34B are electrically connected to the pads 25 arranged on the second face 12*b*.

In other words, the connecting portions 62 of the plurality of pins 34 are arranged in two lines. The connecting portions 62 of the plurality of upper pins 34A included in one of the two lines are electrically connected to the pads 25 on the first face 12*a*. The connecting portions 62 of the plurality of lower pins 34B included in the other of the two lines are electrically connected to the pads 25 on the second face 12*b*. The upper pins 34A include at least one of the D+ pin 34*j*, the D− pin 34*k*, the TX1+ pin 34*f*, the TX1− pin 34*g*, the RX1+ pin 34*b*, and the RX1− pin 34*c*. The lower pins 34B include the other of the D+ pin 34*j*, the D− pin 34*k*, the TX1+ pin 34*f*, the TX1− pin 34*g*, the RX1+ pin 34*b*, and the RX1− pin 34*c*.

The connecting portions 62 of the upper pins 34A are arranged at substantially the same positions in the direction along the Z axis. The connecting portions 62 of the lower pins 34B are arranged at substantially the same positions in the direction along the Z axis.

In the third modified example of the first embodiment, the connecting portions 62 of the D+ pin 34*j*, the D− pin 34*k*, the TX1+ pin 34*f*, the TX1− pin 34*g*, the RX1+ pin 34*b*, and the RX1− pin 34*c* included in one of the two lines are electrically connected to the pads 25 on the first face 12*a*. The pins 34*b*, 34*c*, 34*f*, 34*g*, 34*j*, and 34*k* included in the other of the two lines are electrically connected to the pads 25 on the second face 12*b*. Therefore, a connection state between the pads 25 and the connecting portions 62 of the pins 34*b*, 34*c*, 34*f*, 34*g*, 34*j*, and 34*k* is suppressed from being invisible. Thus, an electrical connection between the pads 25 and the connecting portions 62 of the pins 34*b*, 34*c*, 34*f*, 34*g*, 34*j*, and 34*k* is suppressed from being insufficiently maintained.

Second Embodiment

Next, a second embodiment will be described with reference to FIG. 12. In a description of the following embodiments, elements having the same functions as the above-described elements are denoted by the same reference numerals as those of the above-described elements, and a description thereof may be omitted. A plurality of elements having the same reference numerals may not have the same functions and properties but may have different functions and properties according to embodiments.

Figure 12:
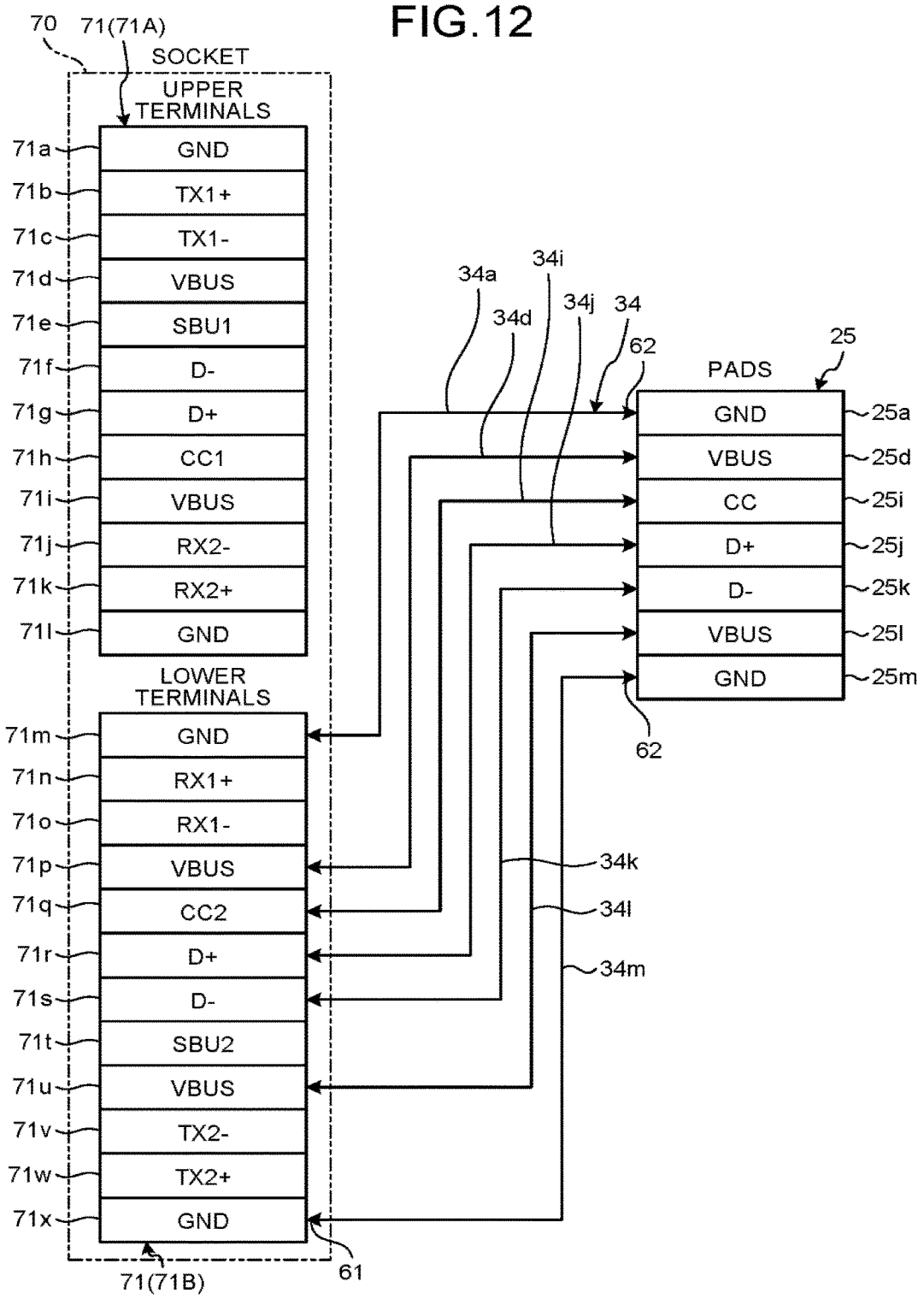
FIG. 12 is a view schematically illustrating an example of a connection among a plurality of pads, a plurality of pins, and a plurality of terminals of a socket according to a second embodiment.

FIG. 12 is a view schematically illustrating an example of a connection among the plurality of pads 25, the plurality of pins 34, and the plurality of terminals 71 of the socket 70 according to the second embodiment. The plurality of pads 25 according to the second embodiment include a GND pad 25*a*, a VBUS pad 25*d*, a CC pad 25*i*, a D+ pad 25*j*, a D− pad 25*k*, a VBUS pad 25*l*, and a ground (GND) pad 25*m* as illustrated in FIG. 12.

The GND pad 25*a*, the VBUS pad 25*d*, the CC pad 25*i*, the D+ pad 25*j*, the D− pad 25*k*, and the VBUS pad 25*l* are the same as those in the first embodiment. The pads 25*a*, 25*d*, 25*i*, 25*j*, 25*k*, 25*l*, and 25*m* are arranged in the direction along the X axis in the above-described order. The pads 25*a*, 25*d*, 25*i*, 25*j*, 25*k*, 25*l*, and 25*m* may be arranged in a different order from the above-described order.

The plurality of pins 34 according to the second embodiment include a GND pin 34*a*, a VBUS pin 34*d*, a CC pin 34*i*, a D+ pin 34*j*, a D− pin 34*k*, a VBUS pin 34*l*, and a ground (GND) pin 34*m*.

The GND pin 34*a*, the VBUS pin 34*d*, the CC pin 34*i*, the D+ pin 34*j*, the D− pin 34*k*, and the VBUS pin 34*l* are the same as those in the first embodiment. The connecting portion 62 of the GND pin 34*m* is electrically connected to the GND pad 25*m*, for example, by soldering. The connecting portion 62 of the GND pin 34*m* is an example of a second contact portion. As described above, the GND pin 34*m* corresponds to the GND pad 25*m*.

When the plug 15 is inserted into the socket 70 in the first orientation, the terminal portion 61 of the GND pin 34*m* comes into contact with the GND terminal 71*x* of the socket 70. The terminal portion 61 of the GND pin 34*m* is an example of a seventh contact portion. The GND pin 34*m* electrically connects the GND terminal 71*x* with the GND pad 25*m*. On the other hand, when the plug 15 is inserted into the socket 70 in the second orientation, the GND pin 34*m* electrically connects the GND terminal 71*a* of the socket 70 with the GND pad 25*m*.

When the plug 15 is inserted into the socket 70 in the first orientation, the insulating part 32 of the plug 15 according to the second embodiment is positioned between the substrate 12 and each of the VBUS terminals 71*d* and 71*i*, the GND terminals 71*a* and 71*l*, the D+ terminal 71*g*, the D− terminal 71*f*, the TX1+ terminal 71*b*, the TX1− terminal 71*c*, the TX2+ terminal 71*w*, the TX2− terminal 71*v*, the RX1+ terminal 71*n*, the RX1− terminal 71*o*, the RX2+ terminal 71*k*, the RX2− terminal 71*j*, the CC1 terminal 71*h*, the SBU1 terminal 71*e*, and the SBU2 terminal 71*t*. In other words, the insulating part 32 of the plug 15 electrically separates the substrate 12 from each of the VBUS terminals 71*d* and 71*i*, the GND terminals 71*a* and 71*l*, the D+ terminal 71*g*, the D− terminal 71*f*, the TX1+ terminal 71*b*, the TX1− terminal 71*c*, the TX2+ terminal 71*w*, the TX2− terminal 71*v*, the RX1+ terminal 71*n*, the RX1− terminal 71*o*, the RX2+ terminal 71*k*, the RX2− terminal 71*j*, the CC1 terminal 71*h*, the SBU1 terminal 71*e*, and the SBU2 terminal 71*t* when the plug 15 is inserted into the socket 70 in the first orientation.

Further, the insulating part 32 of the plug 15 electrically separates the substrate 12 from each of the VBUS terminals 71*p* and 71*u*, the GND terminals 71*m* and 71*x*, the D+ terminal 71*r*, the D− terminal 71*s*, the TX1+ terminal 71*b*, the TX1− terminal 71*c*, the TX2+ terminal 71*w*, the TX2− terminal 71*v*, the RX1+ terminal 71*n*, the RX1− terminal 71*o*, the RX2+ terminal 71*k*, the RX2− terminal 71*j*, the CC2 terminal 71*q*, the SBU1 terminal 71*e*, and the SBU2 terminal 71*t* when the plug 15 is inserted into the socket 70 in the second orientation.

In the second embodiment, the connecting portions 62 of the GND pin 34*a*, the VBUS pin 34*d*, the CC pin 34*i*, the D+ pin 34*j*, the D− pin 34*k*, the VBUS pin 34*l*, and the GND pin 34*m* are arranged in a line. The connecting portions 62 of the pins 34*a*, 34*d*, 34*i*, 34*j*, 34*k*, 34*l*, and 34*m* are arranged in the direction along the X axis in the above-described order. The pins 34*a*, 34*d*, 34*i*, 34*j*, 34*k*, 34*l*, and 34*m* may be arranged in a different order from the above-described order.

In the line of the connecting portions 62 of the pins 34, the connecting portions 62 of the VBUS pin 34*d*, the CC pin 34*i*, the D+ pin 34*j*, the D− pin 34*k*, and the VBUS pin 34*l* are positioned between the connecting portion 62 of the GND pin 34*a* and the connecting portion 62 of the GND pin 34*m*. In other words, the connecting portions 62 of the GND pins 34*a* and 34*m* are positioned at ends of the line of the connecting portions 62 of the pins 34.

The connecting portions 62 of the D+ pin 34*j* and the D− pin 34*k* which are adjacent to each other are positioned between the connecting portions 62 of the GND pin 34*a* and the VBUS pin 34*d* and the connecting portions 62 of the VBUS pin 34*l* and the GND pin 34*m*.

The terminal portions 61 of the D+ pin 34*j* and the D− pin 34*k* which are adjacent to each other are positioned between the terminal portion 61 of at least one of the GND pin 34*a* and the VBUS pin 34*d* and the terminal portion 61 of at least one of the VBUS pin 34*l* and the GND pin 34*m*.

When the plug 15 is inserted into the socket 70, the D+ pin 34*j* and the D− pin 34*k* electrically connect one of the D+ terminals 71*g* and 71*r* and one of the D− terminals 71*f* and 71*s* with the D+ pad 25*j* and the D− pad 25*k*. Thus, the USB drive 10 and the host device can perform data communication complying with the USB 2.0 standard. For example, the USB drive 10 and the host device can perform Low Speed data communication, Full Speed data communication, and High Speed data communication.

In the USB drive 10 according to the second embodiment, the plug 15 electrically separates the substrate 12 from the TX1+ terminal 71*b*, the TX1− terminal 71*c*, the TX2+ terminal 71*w*, and the TX2− terminal 71*v* of the socket 70. Further, the plug 15 electrically separates the substrate 12 from the RX1+ terminal 71*n*, the RX1− terminal 71*o*, the RX2+ terminal 71*k*, and the RX2− terminal 71*j*. Thus, the pins 34 that electrically connect the terminals 71*b*, 71*c*, 71*j*, 71*k*, 71*n*, 71*o*, 71*v*, and 71*w* with the substrate 12 are unnecessary. Accordingly, since the number of pins 34 is reduced to be smaller than that of the male connector complying with the USB Type-C standard, a decrease in the intervals between the plurality of pads 25 is suppressed, and the occurrence of a trouble in an electrical connection between the pad 25 and the pin 34 is suppressed.

The GND pin 34*a*, the VBUS pin 34*d*, the CC pin 34*i*, the D+ pin 34*j*, the D− pin 34*k*, the VBUS pin 34*l*, and the GND pin 34*m* are arranged in a line. Thus, a connection state between the pads 25 and the connecting portions 62 of the pins 34*a*, 34*d*, 34*i*, 34*j*, 34*k*, 34*l*, and 34*m* is suppressed from being invisible. Thus, an electrical connection between the pads 25 and the connecting portions 62 of the pins 34*a*, 34*d*, 34*i*, 34*j*, 34*k*, 34*l*, and 34*m* is suppressed from being insufficiently maintained.

The connecting portions 62 of the D+ pin 34*j* and the D− pin 34*k* are positioned between the connecting portions 62 of the GND pin 34*a* and the VBUS pin 34*d* and the connecting portions 62 of the VBUS pin 34*l* and the GND pin 34*m*. Thus, it is suppressed that the differential signals flowing through the D+ pin 34*j* and the D− pin 34*k* are influenced by the other pins 34.

The terminal portions 61 of the D+ pin 34*j* and the D− pin 34*k* are positioned between the terminal portion 61 of at least one of the GND pin 34*a* and the VBUS pin 34*d* and the terminal portion 61 of at least one of the VBUS pin 34*l* and the GND pin 34*m*. In other words, an arrangement of the terminal portions 61 of the pins 34*a*, 34*d*, 34*j*, 34*k*, 34*l*, and 34*m* has the same arrangement as the connecting portions 62 of the pins 34*a*, 34*d*, 34*j*, 34*k*, 34*l*, and 34*m*. Thus, paths of the pins 34 can be easily designed.

In the line of the connecting portions 62 of the pins 34, the connecting portions 62 of the VBUS pin 34*d*, the D+ pin 34*j*, the D− pin 34*k*, and the VBUS pin 34*l* are positioned between the connecting portion 62 of the GND pin 34*a* and the connecting portion 62 of the GND pin 34*m*. Thus, the D+ pin 34*j* and the D− pin 34*k* are suppressed from undergoing an electrostatic breakdown.

The first to third modified examples of the first embodiment can be applied to the second embodiment. In other words, FIG. 9 can also schematically illustrate a part of the USB drive 10 according to a first modified example of the second embodiment. FIG. 10 can also illustrate a part of the substrate 12 and parts of the plurality of pins 34 according to a second modified example of the second embodiment. FIG. 11 can also schematically illustrate a part of the USB drive 10 according to a third modified example of the second embodiment.

As illustrated in FIG. 9, in the first modified example of the second embodiment, the terminal portions 61 of the plurality of pins 34 are arranged in a line. The connecting portions 62 of the plurality of pins 34 are also arranged in a line. In other words, the lengths of the plurality of pins 34 in the direction along the Y axis are substantially equal. The pins 34 include a GND pin 34*a*, a VBUS pin 34*d*, a CC pin 34*i*, a D+ pin 34*j*, a D− pin 34*k*, a VBUS pin 34*l*, and a GND pin 34*m*.

According to the first modified example of the second embodiment, for example, the GND pin 34*a*, the VBUS pin 34*d*, the CC pin 34*i*, the D+ pin 34*j*, the D− pin 34*k*, the VBUS pin 34*l*, and the GND pin 34*m* can be made by a mold from one metallic plate. Thus, the pins 34*a*, 34*d*, 34*i*, 34*j*, 34*k*, 34*l*, and 34*m* can be easily made.

As illustrated in FIG. 10, in the second modified example of the second embodiment, the connecting portions 62 of the plurality of pins 34 are arranged in two lines. The pins 34 include a GND pin 34*a*, a VBUS pin 34*d*, a CC pin 34*i*, a D+ pin 34*j*, a D− pin 34*k*, a VBUS pin 34*l*, and a GND pin 34*m*. Thus, since the number of pins 34 in each line is reduced, a decrease in the intervals between the plurality of pads 25 is suppressed. Accordingly, the occurrence of a trouble in an electric connection between the pads 25 and the connecting portions 62 of the pins 34*a*, 34*d*, 34*i*, 34*j*, 34*k*, 34*l*, and 34*m* is suppressed.

The connecting portions 62 of the GND pin 34*a*, the VBUS pin 34*d*, the CC pin 34*i*, the D+ pin 34*j*, the D− pin 34*k*, the VBUS pin 34*l*, and the GND pin 34*m* included in one of the two lines and the connecting portions 62 of the pins 34*a*, 34*d*, 34*i*, 34*j*, 34*k*, 34*l*, and 34*m* included in the other of the two lines are arranged to alternate with each other. Thus, the pads 25 and the connecting portions 62 of the pins 34*a*, 34*d*, 34*i*, 34*j*, 34*k*, 34*l*, and 34*m* in one line are suppressed from being hidden by the pads 25 and the connecting portions 62 of the pins 34*a*, 34*d*, 34*i*, 34*j*, 34*k*, 34*l*, and 34*m* in the other line. Accordingly, an electrical connection between the pads 25 and the connecting portions 62 of the pins 34*a*, 34*d*, 34*i*, 34*j*, 34*k*, 34*l*, and 34*m* is suppressed from being insufficiently maintained.

As illustrated in FIG. 11, in the third modified example of the second embodiment, the connecting portions 62 of the plurality of pins 34 included in one of the two lines are electrically connected to the pads 25 on the first face 12*a*. The connecting portions 62 of the plurality of pins 34 included in the other of the two lines are electrically connected to the pads 25 on the second face 12*b*. Thus, a connection state between the pads 25 and the connecting portions 62 of the GND pin 34*a*, the VBUS pin 34*d*, the CC pin 34*i*, the D+ pin 34*j*, the D− pin 34*k*, the VBUS pin 34*l*, and the GND pin 34*m* is suppressed from being invisible. Accordingly, an electrical connection between the pads 25 and the connecting portions 62 of the pins 34*a*, 34*d*, 34*i*, 34*j*, 34*k*, 34*l*, and 34*m* is suppressed from being insufficiently maintained.

Third Embodiment

Figure 13:
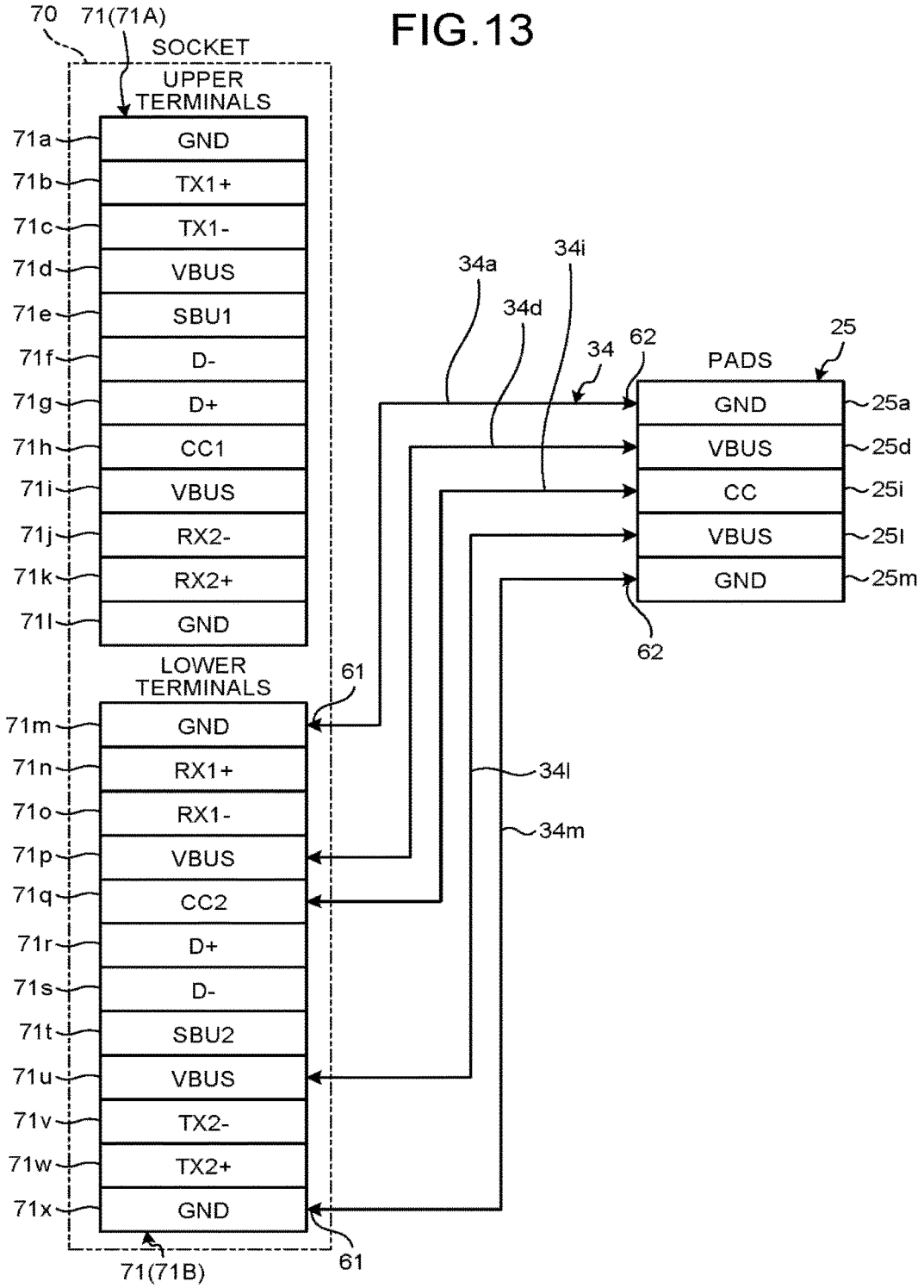
FIG. 13 is a view schematically illustrating an example of a connection among a plurality of pads, a plurality of pins, and a plurality of terminals of a socket according to a third embodiment.

Next, a third embodiment will be described with reference to FIG. 13. FIG. 13 is a view schematically illustrating an example of a connection among the plurality of pads 25, the plurality of pins 34, and the plurality of terminals 71 of the socket 70 according to the third embodiment. As illustrated in FIG. 13, the plurality of pads 25 according to the third embodiment include a GND pad 25*a*, a VBUS pad 25*d*, a CC pad 25*i*, a VBUS pad 25*l*, and a GND pad 25*m*.

The insulating part 32 of the plug 15 according to the third embodiment electrically separates the substrate 12 from each of the VBUS terminals 71*d* and 71*i*, the GND terminals 71*a* and 71*l*, the D+ terminals 71*g* and 71*r*, the D− terminals 71*f* and 71*s*, the TX1+ terminal 71*b*, the TX1− terminal 71*c*, the TX2+ terminal 71*w*, the TX2− terminal 71*v*, the RX1+ terminal 71*n*, the RX1− terminal 71*o*, the RX2+ terminal 71*k*, the RX2− terminal 71*j*, the CC1 terminal 71*h*, the SBU1 terminal 71*e*, and the SBU2 terminal 71*t* when the plug 15 is inserted into the socket 70 in the first orientation.

Further, the insulating part 32 of the plug 15 electrically separates the substrate 12 from each of the VBUS terminals 71*p* and 71*u*, the GND terminals 71*m* and 71*x*, the D+ terminals 71*g* and 71*r*, the D− terminals 71*f* and 71*s*, the TX1+ terminal 71*b*, the TX1− terminal 71*c*, the TX2+ terminal 71*w*, the TX2− terminal 71*v*, the RX1+ terminal 71*n*, the RX1− terminal 71*o*, the RX2+ terminal 71*k*, the RX2− terminal 71*j*, the CC2 terminal 71*q*, the SBU1 terminal 71*e*, and the SBU2 terminal 71*t* when the plug 15 is inserted into the socket 70 in the second orientation.

In the third embodiment, the connecting portions 62 of the GND pin 34*a*, the VBUS pin 34*d*, the CC pin 34*i*, the VBUS pin 34*l*, and the GND pin 34*m* are arranged in a line. The connecting portions 62 of the pins 34*a*, 34*d*, 34*i*, 34*l*, and 34*m* are arranged in the direction along the X axis in the above-described order. The pins 34*a*, 34*d*, 34*i*, 34*l*, and 34*m* may be arranged in a different order from the above-described order.

In the line of the connecting portions 62 of the pins 34, the connecting portions 62 of the VBUS pin 34*d*, the CC pin 34*i*, and the VBUS pin 34*l* are positioned between the connecting portion 62 of the GND pin 34*a* and the connecting portion 62 of the GND pin 34*m*.

When the plug 15 is inserted into the socket 70, the GND pins 34*a* and 34*m* electrically connect one of the GND terminals 71*m* and 71*x* and the GND terminals 71*a* and 71*l* with the GND pads 25*a* and 25*m*. Further, the VBUS pins 34*d* and 34*l* electrically connect one of the VBUS terminals 71*p* and 71*u* and the VBUS terminals 71*d* and 71*i* with the VBUS pads 25*d* and 25*l*. Thus, the USB drive 10 can be supplied with electric power from the host device through the plug 15 and the socket 70.

In the USB drive 10 according to the third embodiment, the plug 15 electrically separates the substrate 12 from the D+ terminals 71*g* and 71*r*, the D− terminals 71*f* and 71*s*, the TX1+ terminal 71*b*, the TX1− terminal 71*c*, the TX2+ terminal 71*w*, the TX2− terminal 71*v*, the RX1+ terminal 71*n*, the RX1− terminal 71*o*, the RX2+ terminal 71*k*, and the RX2− terminal 71*j* of the socket 70. Thus, the pins 34 that electrically connect the terminals 71*b*, 71*c*, 71*f*, 71*g*, 71*j*, 71*k*, 71*n*, 71*o*, 71*r*, 71*s*, 71*v*, and 71*w* with the substrate 12 are unnecessary. Accordingly, since the number of pins 34 is reduced to be smaller than that of the male connector complying with the USB Type-C standard, a decrease in the intervals between the plurality of pads 25 is suppressed, and the occurrence of a trouble in an electrical connection between the pad 25 and the pin 34 is suppressed.

A host device that permits power supply from the socket 70 to the plug 15 when the CC1 terminal 71*h* or the CC2 terminal 71*q* is electrically connected with the CC pad 25*i* is known. The plurality of pins 34 according to the third embodiment include a CC pin 34*i*. Thus, even in the above host device, the USB drive 10 can receive electric power supplied from the host device. The plurality of pins 34 may not include the CC pin 34*i*.

The first to third modified examples of the first embodiment can be applied to the third embodiment. In other words, FIG. 9 can also schematically illustrate a part of the USB drive 10 according to a first modified example of the third embodiment. FIG. 10 can also illustrate a part of the substrate 12 and parts of the plurality of pins 34 according to a second modified example of the third embodiment. FIG. 11 can also schematically illustrate a part of the USB drive 10 according to a third modified example of the third embodiment.

As illustrated in FIG. 9, in the first modified example of the third embodiment, the terminal portions 61 of the plurality of pins 34 are arranged in a line. The connecting portions 62 of the plurality of pins 34 are arranged in a line. In other words, the lengths of the plurality of pins 34 in the direction along the Y axis are substantially equal. The pins 34 include a GND pin 34*a*, a VBUS pin 34*d*, a CC pin 34*i*, a VBUS pin 34*l*, and a GND pin 34*m*.

According to the first modified example of the third embodiment, for example, the GND pin 34*a*, the VBUS pin 34*d*, the CC pin 34*i*, the VBUS pin 34*l*, and the GND pin 34*m* can be made by a mold from one metallic plate. Thus, the pins 34*a*, 34*d*, 34*i*, 34*l*, and 34*m* can be easily made.

As illustrated in FIG. 10, in the second modified example of the third embodiment, the connecting portions 62 of the plurality of pins 34 are arranged in two lines. The pins 34 include the GND pin 34*a*, the VBUS pin 34*d*, the CC pin 34*i*, the VBUS pin 34*l*, and the GND pin 34*m*. Thus, since the number of pins 34 in each line is reduced, a decrease in the intervals between the plurality of pads 25 is suppressed.

Accordingly, the occurrence of a trouble in an electric connection between the pads 25 and the connecting portions 62 of the pins 34*a*, 34*d*, 34*i*, 34*l*, and 34*m* is suppressed.

The connecting portions 62 of the GND pin 34*a*, the VBUS pin 34*d*, the CC pin 34*i*, the VBUS pin 34*l*, and the GND pin 34*m* included in one of the two lines and the connecting portions 62 of the pins 34*a*, 34*d*, 34*i*, 34*l*, and 34*m* included in the other of the two lines are arranged to alternate with each other. Thus, the pads 25 and the connecting portions 62 of the pin 34*a*, 34*d*, 34*i*, 34*l*, and 34*m* in one of the lines are suppressed from being hidden by the pads 25 and the connecting portions 62 of the pin 34*a*, 34*d*, 34*i*, 34*l*, and 34*m* in the other of the lines. Accordingly, an electrical connection between the pads 25 and the connecting portions 62 of the pins 34*a*, 34*d*, 34*i*, 34*l*, and 34*m* is suppressed from being insufficiently maintained.

As illustrated in FIG. 11, in the third modified example of the third embodiment, the connecting portions 62 of the plurality of pins 34 included in one of the two lines are electrically connected to the pads 25 on the first face 12*a*. The connecting portions 62 of the plurality of pins 34 included in the other of the two lines are electrically connected to the pads 25 on the second face 12*b*. Thus, a connection state between the pads 25 and the connecting portion 62 of the pins 34*a*, 34*d*, 34*i*, 34*l*, and 34*m* is suppressed from being invisible. Accordingly, an electrical connection between the pads 25 and the connecting portions 62 of the pins 34*a*, 34*d*, 34*i*, 34*l*, and 34*m* is suppressed from being insufficiently maintained.

In the plurality of above embodiments, two or more of the plurality of VBUS terminals 71*d*, 71*i*, 71*p*, and 71*u* are electrically connected to the pads 25. Thus, an electric current complying with the USB Type-C standard is supplied from the host device to the USB drive 10. However, the plurality of pins 34 may electrically connect one of the plurality of VBUS terminals 71*d*, 71*i*, 71*p*, and 71*u* with one of the pads 25.

According to at least one of the above-described embodiments, the number of a plurality of conductive members each of which is configured to electrically connect one of a plurality of terminals mounted in the female connector with one of a plurality of pads when inserted into the female connector is smaller than the number of the plurality of terminals. Thus, the occurrence in a trouble in an electric connection between the pad and the conductive member is suppressed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A storage device, comprising:

a substrate including a plurality of conductors on the substrate;

a male connector that is mounted on the substrate and insertable into an external female connector that includes twenty-four terminals and complies with a USB Type-C standard;

a first conductive member that is mounted in the male connector and configured to electrically connect one of at least one power terminal of the terminals of the external female connector with one of at least one first conductor among the plurality of conductors in the case that the male connector is inserted into the external female connector;

a second conductive member that is mounted in the male connector and configured to electrically connect one of at least one ground terminal of the terminals of the external female connector with one of at least one second conductor among the plurality of conductors in the case that the male connector is inserted into the external female connector; and a pair of third conductive members that are mounted in the male connector and configured to electrically connect a pair of differential signal terminals of the terminals of the external female connector with a third conductor and a fourth conductor among the plurality of conductors, respectively, in the case that the male connector is inserted into the external female connector.

2. The storage device according to claim 1, further comprising:

a pair of fourth conductive members that are mounted in the male connector and configured to electrically connect one of a pair of first transmission differential signal terminals and a pair of second transmission differential signal terminals of the terminals of the external female connector with a fifth conductor and a sixth conductor among the plurality of conductors, respectively, in the case that the male connector is inserted into the external female connector; and a pair of fifth conductive members that are mounted in the male connector and configured to electrically connect one of a pair of first reception differential signal terminals and a pair of second reception differential signal terminals of the terminals of the external female connector with a seventh conductor and an eighth conductor among the plurality of conductors, respectively, in the case that the male connector is inserted into the external female connector, wherein the male connector is configured to electrically separate the substrate from the other of the pair of first transmission differential signal terminals and the pair of second transmission differential signal terminals, and electrically separate the substrate from the other of the pair of first reception differential signal terminals and the pair of second reception differential signal terminals in the case that the male connector is inserted into the external female connector.

3. The storage device according to claim 2, wherein the first conductive member includes a first contact portion connected to one of the at least one first conductor, the second conductive member includes a second contact portion connected to one of the at least one second conductor, the pair of third conductive members include a pair of third contact portions connected to the third and fourth conductors, the pair of fourth conductive members include a pair of fourth contact portions connected the fifth and sixth conductors, the pair of fifth conductive members include a pair of fifth contact portions connected to the seventh and eighth conductors, and the first to fifth contact portions are arranged in a line.

4. The storage device according to claim 3, wherein the first conductive member includes a sixth contact portion configured to come into contact with one of the at least one power terminal in the case that the male connector is inserted into the external female connector, the second conductive member includes a seventh contact portion configured to come into contact with one of the at least one ground terminal in the case that the male connector is inserted into the external female connector, the pair of third conductive members include a pair of eighth contact portions configured to come into contact with the pair of differential signal terminals in the case that the male connector is inserted into the external female connector, the pair of fourth conductive members include a pair of ninth contact portions configured to come into contact with one of the pair of first transmission differential signal terminals and the pair of second transmission differential signal terminals in the case that the male connector is inserted into the external female connector, the pair of fifth conductive members include a pair of tenth contact portions configured to come into contact with one of the pair of first reception differential signal terminals and the pair of second reception differential signal terminals in the case that the male connector is inserted into the external female connector, and the sixth to tenth contact portions are arranged in a line.

5. The storage device according to claim 2, wherein the first conductive member includes a first contact portion connected to one of the at least one first conductor, the second conductive member includes a second contact portion connected to one of the at least one second conductor, the pair of third conductive members include a pair of third contact portions connected to the third and fourth conductors, the pair of fourth conductive members include a pair of fourth contact portions connected the fifth and sixth conductors, the pair of fifth conductive members include a pair of fifth contact portions connected to the seventh and eighth conductors, and the first to fifth contact portions are arranged in two lines.

6. The storage device according to claim 5, wherein the substrate has a substantially rectangular shape in a planar view, each of the two lines of the first to fifth contact portions extends in a short-side direction of the substrate, contact portions included in one of the two lines among the first to fifth contact portions are arranged to alternate with contact portions included in the other of the two lines among the first to fifth contact portions in the short-side direction.

7. The storage device according to claim 5, wherein the substrate includes a first face and a second face at an opposite side to the first face, the plurality of conductors are mounted on the first face and the second face, one of at least one contact portion included in one of the two lines among the first to fifth contact portions is connected to one of at least one conductor mounted on the first face among the plurality of conductors, and one of at least one contact portion included in the other of the two lines among the first to fifth contact portions is connected to one of at least one conductor mounted on the second face among the plurality of conductors.

8. The storage device according to claim 3, wherein the substrate has a substantially rectangular shape in a planar view, the first to fifth contact portions are arranged in a short-side direction of the substrate, the pair of third contact portions are adjacent in the short-side direction of the substrate, the pair of fourth contact portions are adjacent in the short-side direction of the substrate, the pair of fifth contact portions are arranged in the short-side direction of the substrate, at least one of the first contact portion and the second contact portion is arranged between every two of the pair of third contact portions, the pair of fourth contact portions, and the pair of fifth contact portions.

9. A storage device, comprising:

a substrate;

a male connector that is mounted on the substrate and insertable into an external female connector complying with a USB Type-C standard;

a plurality of first conductive members that are mounted in the male connector and configured to be electrically connected to a plurality of power terminals mounted in the external female connector, respectively, in a case that the male connector is inserted into the external female connector;

a plurality of first conductors that are mounted on the substrate and connected to the plurality of first conductive members, respectively;

a plurality of second conductive members that are mounted in the male connector and configured to be electrically connected to a plurality of ground terminals mounted in the external female connector, respectively, in the case that the male connector is inserted into the external female connector;

a plurality of second conductors that are mounted on the substrate and connected to the plurality of second conductive members, respectively;

a pair of third conductive members that are mounted in the male connector and configured to be electrically connected to a pair of differential signal terminals mounted in the external female connector in the case that the male connector is inserted into the external female connector;

a third conductor and a fourth conductor that are mounted on the substrate and connected to the pair of third conductive members, respectively;

a pair of fourth conductive members that are mounted in the male connector and configured to be electrically connected to one of a pair of first transmission differential signal terminals and a pair of second transmission differential signal terminals mounted in the external female connector in the case that the male connector is inserted into the external female connector;

a fifth conductor and a sixth conductor that are mounted on the substrate and connected to the pair of fourth conductive members, respectively;

a pair of fifth conductive members that are mounted in the male connector and configured to be electrically connected to one of a pair of first reception differential signal terminals and a pair of second reception differential signal terminals mounted in the external female connector in the case that the male connector is inserted into the external female connector; and a seventh conductor and an eighth conductor that are mounted on the substrate and connected to the pair of fifth conductive members, respectively.

10. The storage device according to claim 9, wherein each of the plurality of first conductive members includes a first contact portion, each of the plurality of first conductors connected to the first contact portion, each of the plurality of second conductive members includes a second contact portion, each of the plurality of second conductors connected to the second contact portion, the pair of third conductive members include a pair of third contact portions connected to the third and fourth conductors, the pair of fourth conductive members include a pair of fourth contact portions connected the fifth and sixth conductors, the pair of fifth conductive members include a pair of fifth contact portions connected to the seventh and eighth conductors, the substrate has a substantially rectangular shape in a planar view, the pair of fourth contact portions are adjacent in a short-side direction of the substrate, the pair of fifth contact portions are adjacent in the short-side direction of the substrate, the pair of fourth contact portions are positioned between the first contact portion included in one of the plurality of first conductive members and the second contact portion included in one of the plurality of second conductive members, and the pair of fifth contact portions are positioned between the first contact portion included in one of the plurality of first conductive members and the second contact portion included in one of the plurality of second conductive members.

11. The storage device according to claim 10, wherein each of the plurality of first conductive members includes a sixth contact portion configured to come into contact with one of the plurality of power terminals in the case that the male connector is inserted into the external female connector, each of the plurality of second conductive members includes a seventh contact portion configured to come into contact with one of the plurality of ground terminals in the case that the male connector is inserted into the external female connector, the pair of third conductive members include a pair of eighth contact portions configured to come into contact with the pair of differential signal terminals in the case that the male connector is inserted into the external female connector, the pair of fourth conductive members include a pair of ninth contact portions configured to come into contact with one of the pair of first transmission differential signal terminals and the pair of second transmission differential signal terminals in the case that the male connector is inserted into the external female connector, the pair of fifth conductive members include a pair of tenth contact portions configured to come into contact with one of the pair of first reception differential signal terminals and the pair of second reception differential signal terminals in the case that the male connector is inserted into the external female connector, the pair of ninth contact portions are positioned between the sixth contact portion included in one of the plurality of first conductive members and the seventh contact portion included in one of the plurality of second conductive members, and the pair of tenth contact portions are positioned between the sixth contact portion included in one of the plurality of first conductive members and the seventh contact portion included in one of the plurality of second conductive members.

12. The storage device according to claim 10, further comprising:

a ninth conductor mounted on the substrate; and a sixth conductive member that is mounted in the male connector and configured to electrically connect a configuration channel signal terminal mounted in the external female connector with the ninth conductor in the case that the male connector is inserted into the external female connector, wherein the sixth conductive member includes an eleventh contact portion connected to the ninth conductor, and the first contact portion, the pair of third contact portions, and the eleventh contact portion are arranged in the short-side direction of the substrate, and the pair of third contact portions are positioned between the eleventh contact portion and the first contact portion included in one of the plurality of first conductive members.

13. The storage device according to claim 1, wherein the male connector is configured to electrically separate the substrate from a pair of first transmission differential signal terminals, a pair of second transmission differential signal terminals, a pair of first reception differential signal terminals, and a pair of second reception differential signal terminals mounted in the external female connector in the case that the male connector is inserted into the external female connector.

14. The storage device according to claim 13, wherein the first conductive member includes a first contact portion connected to one of the at least one first conductor, the second conductive member includes a second contact portion connected to one of the at least one second conductor, the pair of third conductive members include a pair of third contact portions connected to the third and fourth conductors, and the first to third contact portions arranged in a line.

15. The storage device according to claim 14, wherein the first conductive member includes a first terminal portion configured to come into contact with one of the at least one power terminal in the case that the male connector is inserted into the external female connector, the second conductive member includes a second terminal portion configured to come into contact with one of the at least one ground terminal in the case that the male connector is inserted into the external female connector, the pair of third conductive members include a pair of third terminal portions configured to come into contact with the pair of differential signal terminals in the case that the male connector is inserted into the external female connector, and the first to the third terminal portions are arranged in a line.

16. The storage device according to claim 14, wherein the at least one second conductive member includes a plurality of second conductive members, the first contact portion and the pair of third contact portions are positioned between the second contact portion of one of the second conductive members and the second contact portion of another of the second conductive members in the line.

17. The storage device according to claim 13, wherein the first conductive member includes a first contact portion connected to one of the at least one first conductor, the second conductive member includes a second contact portion connected to one of the at least one second conductor, the pair of third conductive members include a pair of third contact portions connected to the third and fourth conductors, the substrate has a substantially rectangular shape in a planar view, and the first to the third contact portions are arranged in two lines in a short-side direction of the substrate.

18. The storage device according to claim 17, wherein each of the two lines of the first to third contact portions extends in the short-side direction of the substrate, and contact portions included in one of the two lines among the first to third contact portions are arranged to alternate with contact portions included in the other of the two lines among the first to third contact portions in the short-side direction.

19. The storage device according to claim 13, wherein the first conductive member includes a first contact portion connected to one of the at least one first conductor, the second conductive member includes a second contact portion connected to one of the at least one second conductor, the pair of third conductive members include a pair of adjacent third contact portions connected to the third and fourth conductors, the first to third contact portions arranged in a line, and the pair of third contact portions are positioned between the first contact portion and the second contact portion.

20. The storage device according to claim 19, wherein the first conductive member includes a first terminal portion configured to come into contact with one of the at least one power terminal in the case that the male connector is inserted into the external female connector, the second conductive member includes a second terminal portion configured to come into contact with one of the at least one ground terminal in the case that the male connector is inserted into the external female connector, the pair of third conductive members include a pair of third terminal portions configured to come into contact with the pair of differential signal terminals in the case that the male connector is inserted into the external female connector, the first to third terminal portions arranged in a line, and the pair of third terminal portions are positioned between the first terminal portion and the second terminal portion.

* * * * *